US006555953B1

(12) United States Patent
Nishizawa et al.

(10) Patent No.: US 6,555,953 B1
(45) Date of Patent: Apr. 29, 2003

(54) FLAT FACE TYPE COLOR CATHODE RAY TUBE HAVING PANEL WITH CURVED INNER SURFACE

(75) Inventors: Masahiro Nishizawa, Mobara (JP); Hiroshi Yoshioka, Mobara (JP); Yoshiyuki Odaka, Isumi (JP); Toshio Tojo, Ichinomiya (JP)

(73) Assignees: Hitachi Ltd., Tokyo (JP); Hitachi Device Engineering Co., Chiba-Ken (JP)

( * ) Notice: Subject to any disclaimer, the term of this patent is extended or adjusted under 35 U.S.C. 154(b) by 81 days.

(21) Appl. No.: 09/619,217

(22) Filed: Jul. 19, 2000

(30) Foreign Application Priority Data

Sep. 30, 1999 (JP) ..... 11-280131

(51) Int. Cl.[7] ..... H01J 29/10; H01J 29/18; H01J 29/88; H01J 31/00

(52) U.S. Cl. ..... 313/461; 313/466; 313/478; 313/479; 313/474; 220/2.1 A; 220/2.1 R

(58) Field of Search ..... 313/461, 466, 313/478, 479, 477 R, 480, 474; 220/2.1 A, 2.1 R

(56) References Cited

U.S. PATENT DOCUMENTS 5,065,071 A * 11/1991 Donofrio et al. ..... 313/474
5,640,066 A * 6/1997 Itou et al. ..... 313/461
5,814,933 A * 9/1998 Iwata et al. ..... 313/477 R
5,939,821 A * 8/1999 Itou et al. ..... 313/112
6,066,914 A * 5/2000 Shimizu et al. ..... 313/461
6,093,349 A * 7/2000 Ihara et al. ..... 252/582
6,133,686 A * 10/2000 Inoue et al. ..... 220/2.1 A
6,366,012 B1 * 4/2002 Lee et al. ..... 313/466

FOREIGN PATENT DOCUMENTS

JP 2001332196 A * 11/2001 ..... H01J/29/88

* cited by examiner

*Primary Examiner*—Nimeshkumar D. Patel
*Assistant Examiner*—Karabi Guharay
(74) *Attorney, Agent, or Firm*—Milbank, Tweed, Hadley & McCloy LLP

(57) ABSTRACT

A color cathode ray tube of the present invention includes an evacuated envelop that is structured from a panel having a phosphor screen on its inner surface, a neck portion containing therein an electron gun assembly, and a cone-shaped section called the funnel for integrally coupling the panel and the neck together, wherein when the main scanning direction of a display screen formed of the panel is defined as an X direction whereas a direction at right angles to the main scan direction is as a Y-direction, an equivalent radius of curvature $R_{xo}$ of an outer surface of the panel in the X direction is at least 2.6 times greater than an equivalent curvature radius $R_{xi}$ of the inner surface while forming on the inner panel surface an inside light absorption layer that is comprised of pigments as its principal component.

14 Claims, 19 Drawing Sheets

PRIOR ART

FLAT FACE TYPE COLOR CATHODE RAY TUBE HAVING PANEL WITH CURVED INNER SURFACE

BACKGROUND OF THE INVENTION

In recent years, color cathode ray tubes of the so-called flat face type or flat panel type are widely employed in television receiver sets and personal computer monitors. From a viewpoint of manufacturability and manufacturing cost, such flat panel type color cathode ray tubes are generally designed so that the outer surface of a display panel is formed into a substantially flat plane through increase of a radius of curvature (equivalent radius of curvature) thereof while forming on an inner panel surface a phosphor screen into a curved plane having a relatively small radius of curvature (equivalent radius of curvature) that is as small as possible not to spoil the flatness of display images. Due to this panel design, a peripheral portion of such panel is greater in thickness than a central portion thereof, which leads to the risk of multi-reflection of externally incident rays of light at the thick panel peripheral portion resulting in a degradation of quality of display images.

See FIG. 36, which is a diagram for explanation of an image quality degradation occurring when external light rays are reflected off at a panel of the flat panel color cathode ray tube. In FIG. 36, reference numeral "1" is used to designate a panel; 1*a* denotes a display screen section of the panel; 1*b* indicates a skirt section; 1*c* is a non-glare antistatic layer; line segment Z—Z shows a tube phosphor screen. As shown in FIG. 36, externally incident light rays $L_i$ are reflected off at an outer panel surface while at the same time behaving to reflect at an inner panel face to thereby outgo as reflected light $L_r$ from the outer panel face, which would result in a decrease in viewability of picture images as visually displayed on the panel screen. Furthermore, the thick panel peripheral portion might also experience occurrence of multireflection in association with inner face reflection, which results in overlapping or "superposition" of multiple reflection image components onto a display image, thereby further reducing the viewability. It should be noted that although the discussion in conjunction with FIG. 36 was done while neglecting any possible influence of reflection on the outer panel face, such outer face reflection will hardly be precluded completely even when employing the nonglare antistatic layer 1*c*.

A cathode ray tube with an optical selection/absorption layer provided between the inner panel face and phosphor screen has been disclosed in Japanese Patent Application Laid-Open Hei 4-345737/1992. The optical select/absorb layer as taught from this Japanese document is comprised of a mixture of more than two materials including organic or inorganic pigment or dye materials, wherein these pigment/dye materials are in the form of fine powdery grains or particles with a grain size of 1.0 micrometer ($\mu$m) or less and also with two or more maximal spectral absorption peaks while forming on the outer panel face a mixture layer of a conductive material and a binder, or a single-layered antireflection layer that is lower in refractivity than a glass panel, or alternatively a multilayer antireflection film including two to four layers of different refractivities, or still alternatively a film with conductive particles made of ATO or ITO or else mixed into this multilayered antireflection film.

Another cathode ray tube is disclosed in Japanese Patent Application Laid-Open Hei 5-182604/1993, wherein in order to let its panel be uniform in optical transmissivity, a chosen coloring agent is mixed into a silica binder and is then spray-coated on an outer panel surface with the resultant coat density being variable so that a density value is high at a central portion and low at a peripheral portion; then, a conductive agent with no coloring agents added thereto is spray coated thereon to form a convex-concave surface configuration having its glossiness (gloss value) that is adjustable with a change in amount of ethylene glycol being added to a coating liquid used.

A color cathode ray tube is disclosed in U.S. Pat. No. 4,815,821, wherein the cathode ray tube includes a glass panel having on its inner surface a first transparent layer that is higher in refractivity than the panel glass, a black matrix (BM) formed thereon, and a second transparent layer overlying the black matrix to have reflectivity less than that of the first transparent layer, and wherein the refractivity of the first transparent layer is designed to fall within a range of 1.7 to 2.0 while letting each transparent layer be set at a quarter of the wavelength of visible light.

With flat panel color cathode ray tubes, it is required to lessen the radius of curvature of an inner panel surface to the extent that the lack of flatness is avoided when viewing on-screen display images by human eyes, thereby offering increased manufacturability and enhanced surface flatness of a tube bulb (evacuated envelop). As currently available color cathode ray tubes are typically designed to add a significant difference in radius of curvature to the panel's inner surface and outer face in the way discussed above, the resulting plate thickness becomes greater at the periphery than at the center part thereof, which in turn results in occurrence of a problem that those display images at the panel periphery are made darker than an image being displayed at the center of such panel.

One prior known approach to reducing a difference in brightness or luminance intensity between the panel center and periphery is to employ a panel made of certain glass materials with increased optical transmissivities. Unfortunately this approach is encountered with problems which follow: the higher the optical transmissivity, the lower the contrast of display images; and, the operability of letting a glass material per se absorb for attenuation multireflection light rays at the panel's inner and outer surfaces might likewise decrease resulting in a decrease in color purity.

Furthermore, in addition to improving the display image quality, it is also a must for color cathode ray tubes to meet the strict need for satisfying ergonomics design requirements including, but not limited to, preclusion of extraneous electromagnetic radiation and external attendant light prevention.

SUMMARY OF THE INVENTION

The present invention is to provide a flat panel color cathode ray tube excellent in panel face flatness and image contrast plus extended color reproduction range. To this end, the color cathode ray tube in accordance with this invention is specifically arranged to employ an inside light absorption layer containing therein inorganic pigment at a selected portion lying adjacent to a panel than a light absorption matrix (black matrix) on an inner panel surface or adversely providing an inside light absorption layer containing such inorganic pigment on or over the light absorption matrix (on an electron gun assembly side) to thereby suppress unwanted creation of multireflection on both the inner panel surface and outer surface, thus correcting or compensating for any possible difference in light absorption amount which can occur due to the presence of a plate thickness difference between a central portion and a peripheral portion of the panel. Another principal concept of the invention lies in forming on the outer panel surface an outside light absorption layer which consists essentially of a conductive microparticle layer that offers light absorbability by itself and a low refractivity layer overlying this microparticle layer with this layer being less in refractivity than the microparticle layer. The conductive microparticle layer is such that a binder is permeated into gaps defined among neighboring microparticles, wherein the former is less in refractivity than the latter. This outside light absorption layer is expected to function also as an antistatic nonglare layer.

Still another principle of the color cathode ray tube of the invention is that the inside light absorption layer being formed on the inner panel surface is specifically arranged so that this layer is greater in thickness at the central part of a panel whereas the same layer is relatively thin at a peripheral portion thereof.

The panel of the color cathode ray tube of the invention is such that an equivalent radius of curvature as measured in an X direction stays identical in value at any locations along a Y direction while simultaneously letting an equivalent radius of curvature in the X direction be kept identical at any locations in the X direction. In addition, the equivalent radius of curvature of either an outer surface or inner face of the panel may also be substantially the same in value along the X and Y directions. Use of such panel curvature shape may suppress distortion of on-screen display images while improving implosion preventability of the cathode ray tube.

The panel of the color cathode ray tube of the invention is designed so that a relation of an outside equivalent radius of curvature $R_{xo}$ and inside equivalent radius of curvature $R_{xi}$ in the X direction with respect to the outer panel surface's reference equivalent radius of curvature $R_{vo}$ and the inner panel face's reference equivalent radius of curvature $R_{vi}$ is determined to satisfy $R_{xo} \geqq 10R_{vo}$ and $R_{xi} \leqq 4R_{vi}$—preferably, $R_{xo} \geqq 30R_{vo}$ and $R_{xi} \leqq 3R_{vi}$.

The color cathode ray tube of the invention is such that when letting a main scanning direction on a display screen as formed in the panel be X direction while letting a specified direction at right angles to the main scan direction be Y direction, the panel's inside equivalent radius of curvature $R_{xi}$ in the X direction is greater than the inside equivalent radius of curvature $R_{xi}$ by at least 2.6 times, preferably 5 times or above, more preferably 10 times or greater, wherein the tube has an inside light absorption layer on the inner panel surface. Further, said inside light absorption layer comprises pigment as its principal component, wherein a light absorption amount in luminous absorptivity of the inside light absorption layer at the center of said panel is designed to fall within a range of 10 to 60 percent (%), preferably 14 to 45%, more preferably 20–30%. Note here that the term "luminous absorptivity" (T) as used herein may be a specific value as defined by Equation (1) which follows:

$$T=(\int T(\lambda)V(\lambda)d\lambda)/(\int V(\lambda)d\lambda) \quad (1)$$

where T(λ) is the absorption rate in a selected range of from 380 to 780 nanometers (nm) of wavelength (λ), and V(λ) is the relative luminous sensitivity in the wavelength range of 380 to 780 nm.

Additionally the light absorption amount as stated herein is to be understood to mean a value that is given by "100-LT," where LT is the optical transmissivity (%).

With the color cathode ray tube of the invention, said transmissivity at the panel center may be greater than or equal to 70%, preferably 80% or more.

The color cathode ray tube of the invention is such that at least in the X direction of its panel, the equivalent radius of curvature $R_{xo}$ of the outer panel surface is greater than the inside equivalent radius of curvature $R_{xi}$ by 2.6 times or above, preferably 5 times or above, more preferably 10 times or more, wherein the tube has its inside light absorption layer overlying the inner panel surface and also has on said outer panel face an outside light absorption layer including an antireflective nonglare layer and antistatic layer, wherein said outside light absorption layer is greater in optical absorptivity at the panel center and yet is less at a peripheral portion of the panel, wherein said outside light absorption layer is comprised of a plurality of layers including at least one electrically insulative layer and more than one conductive layer, and wherein the conductive layer has its sheet resistance that is less in value at the panel center than at the periphery thereof.

BRIEF DESCRIPTION OF THE DRAWINGS

FIG. 9(*b*) is an explanation diagram of a distribution pattern of a film thickness (D) of the outside light absorption layer along X—X direction of FIG. 9(*a*). FIG. 9(*c*) is an explanation diagram of a distribution of sheet resistivity (R) the outside light absorption layer along X—X direction of FIG. 9(*a*). FIG. 31(*b*) is a diagram for explanation of a direction for formation of a surface resistance grading therealong. FIG. 32(*b*) is a diagram showing the direction of such surface resistance grading as formed in the embodiment shown in FIG. 32(*a*). FIG. 33(*b*) is an equivalent circuit of FIG. 33(*a*).

DETAILED DESCRIPTION OF PREFERRED EMBODIMENTS

Figure 35:
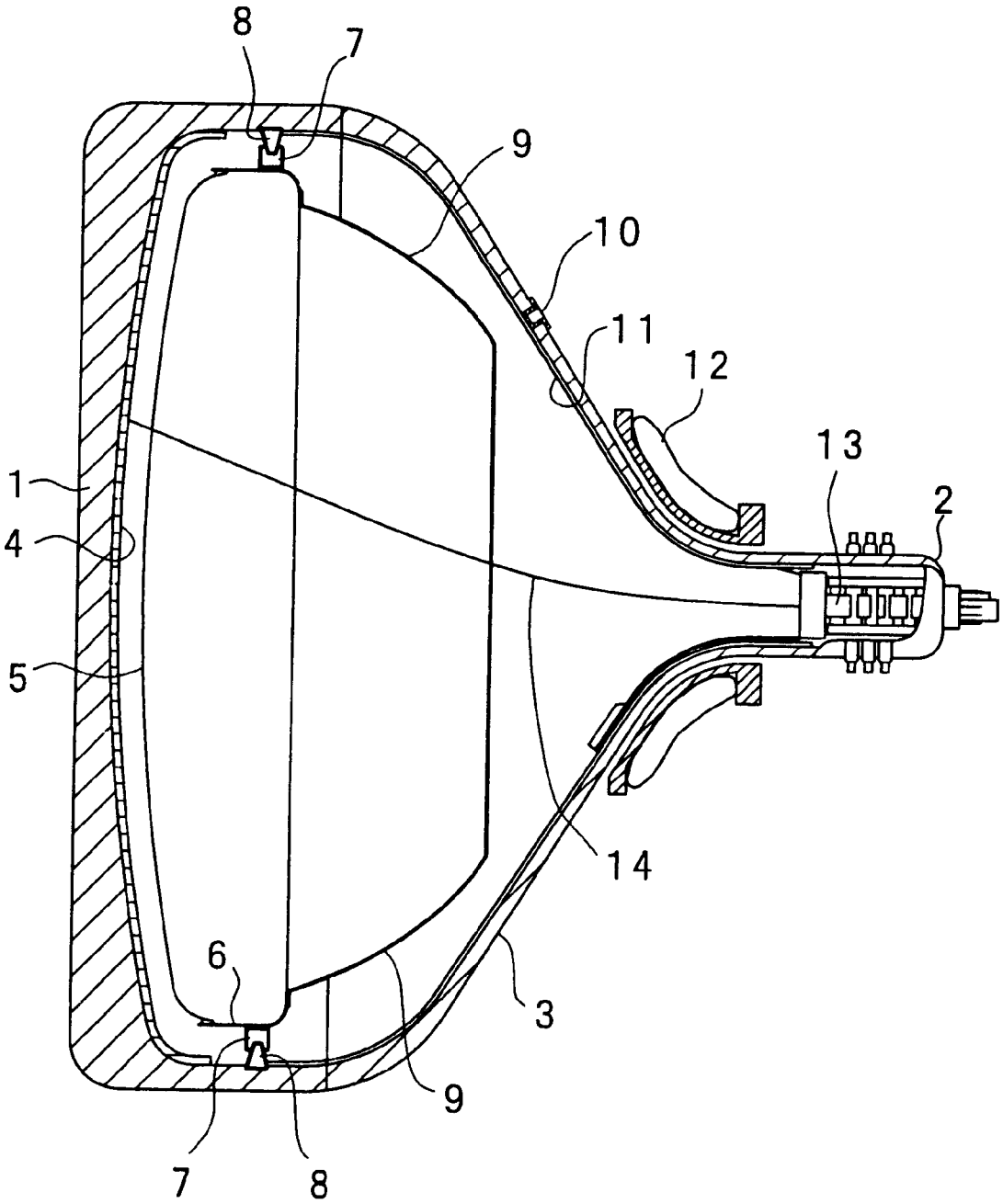
FIG. 35 is a diagram schematically showing in cross-section a flat panel color cathode ray tube.

Referring now to FIG. 35, there is shown a sectional view of a flat panel color cathode ray tube in accordance with one preferred embodiment of the present invention. In FIG. 35, numeral "1" is used to designate a panel; 2 denotes a neck portion; 3 indicates a cone-shaped section, also known as a funnel; 4 is a phosphorus layer, called phosphor screen; 5 is a shadow mask for use as a color selection electrode; 6, a mask frame; 7, suspension springs; 8, stud pins; 9, internal magnetic shield; 10, anode button; 11, inner conductive film; 12, deflection yoke (DY) unit; 13, electron gun assembly; 14, electron beam(s). In addition the phosphor screen 4 is designed so that phosphors of three primary colors are coated on an inner panel surface in the form of either dot-like shape or stripe shape, wherein three electron beams emitted from the electron gun assembly 13 which extend in one plane, the "in-line" plane, are deflected by the deflection yoke 12 into a horizontal (X) direction and a vertical (Y) direction for reproduction or "replication" of an image on the phosphor screen 4.

In the manufacture of flat panel color cathode ray tubes, it is easy to permit the panel's outer face shape to come closer a plane. However, letting the panel's inner surface approximate the plane while retaining the panel's mechanical strength might lead to noticeable increase in plate thickness over the entire surface area of such panel, which would result in an unwanted decrease in display image quality and also an increase in weight and production cost or else. On the other hand, in order to allow the shadow mask to retain its independent or "stand-alone" shape, a need is felt to cause a mask surface to have a certain curvature rather than a complete flat plane. In view of the fact that currently available techniques for manufacture of a shadow mask with increased radius of curvature using press forming methods are associated with technological limitations, it should also be required that the shadow mask be given a prespecified curvature while simultaneously forcing the inner panel face to have a specified curvature.

The curvature of the cathode ray tube panel is definable using an equivalent radius of curvature. Even for a panel of the same curvature, its shape seen to human eyes will vary depending upon the display screen size thereof—in some cases, it is observed as a flat plane; in other cases, seen to be a curved plane. In this invention, the surface flatness (degree of plane) as observed by human eyes is evaluated based on a procedure for quantitatively determining exactly how large its value relative to a normalized reference radius (1R) as indicated by Equations (2) and (3) presented below:

$$R_{vo}=42.5V+45 \tag{2}$$

$$R_{vi}=40V+40 \tag{3}$$

where, $R_{vo}$ is the reference or "standard" equivalent radius of curvature (mm) of an outer panel surface with its effective display screen size (also known as visual size in the art) V, and $R_{vi}$ is the reference equivalent radius of curvature (mm) of an inner panel surface. The V value may typically be eighteen (18) in existing color cathode ray tubes with a nominal diagonal screen size of 19 inches.

Figure 12:
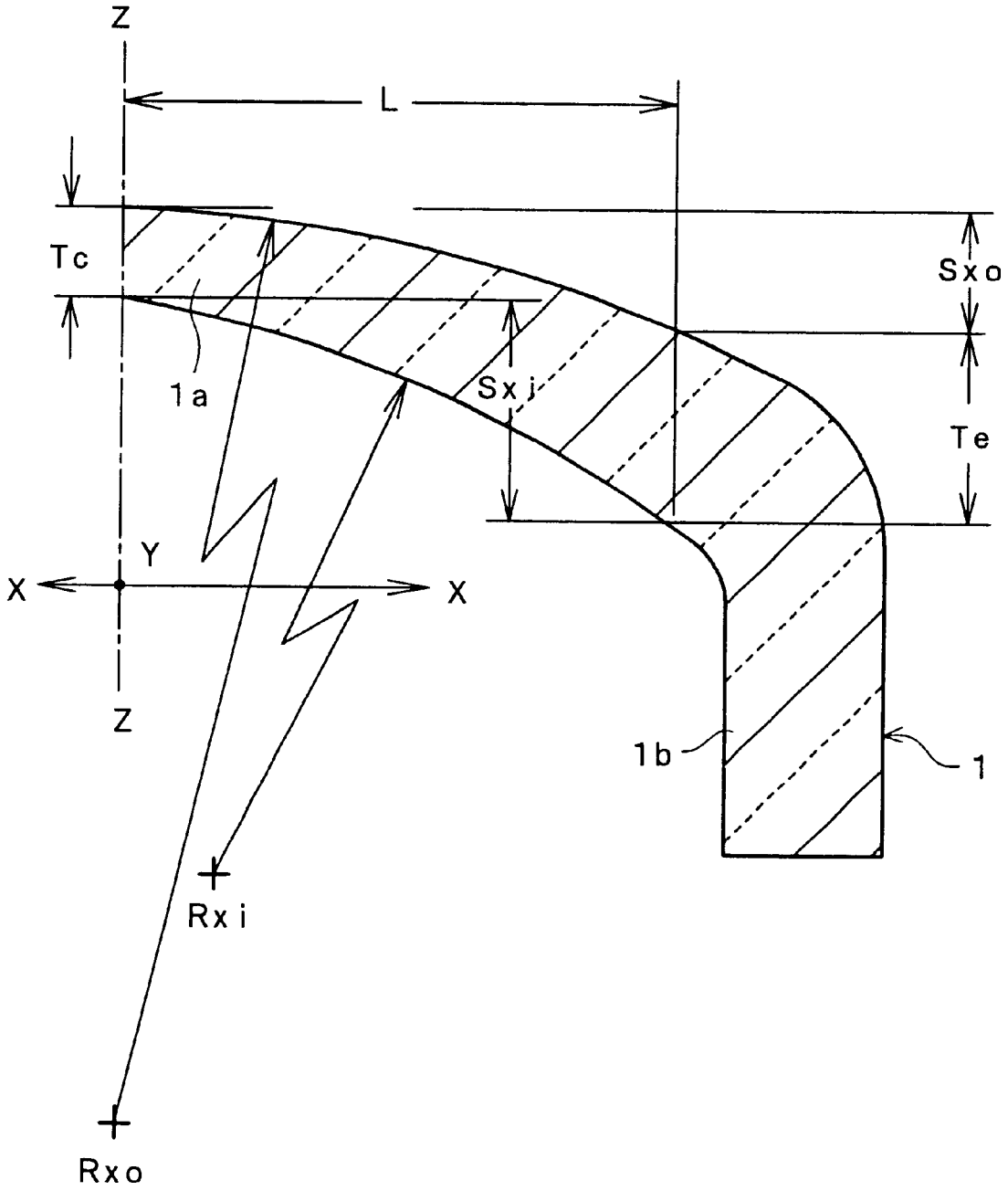
FIG. 12 is a diagram for explanation of the definition of an equivalent radius of curvature relative to the panel's outer surface and inner face.
Figure 13:
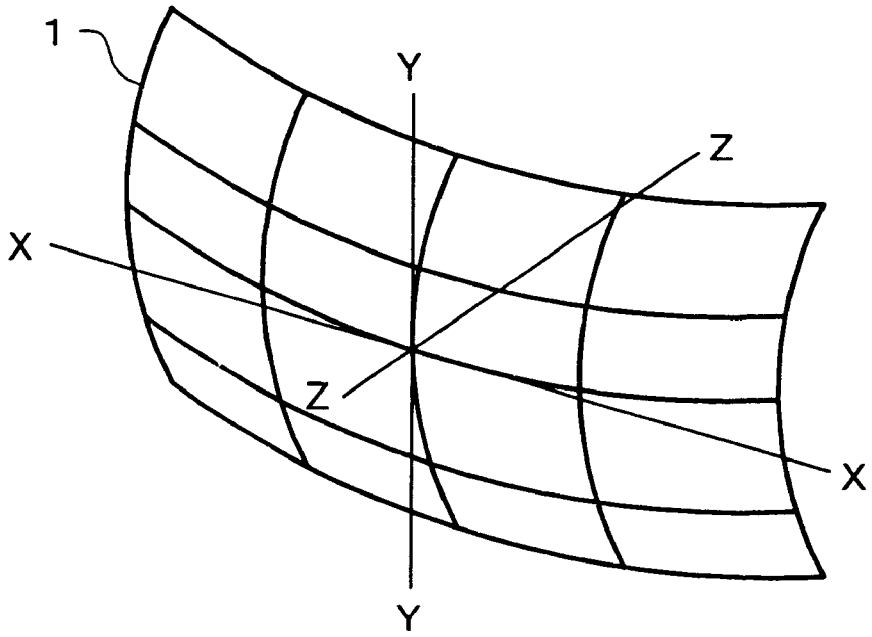
FIGS. 13 to 15 are diagrams each of which is for explanation of the equivalent radius of curvature of the panel of the color cathode ray tube embodying the invention.
Figure 14:
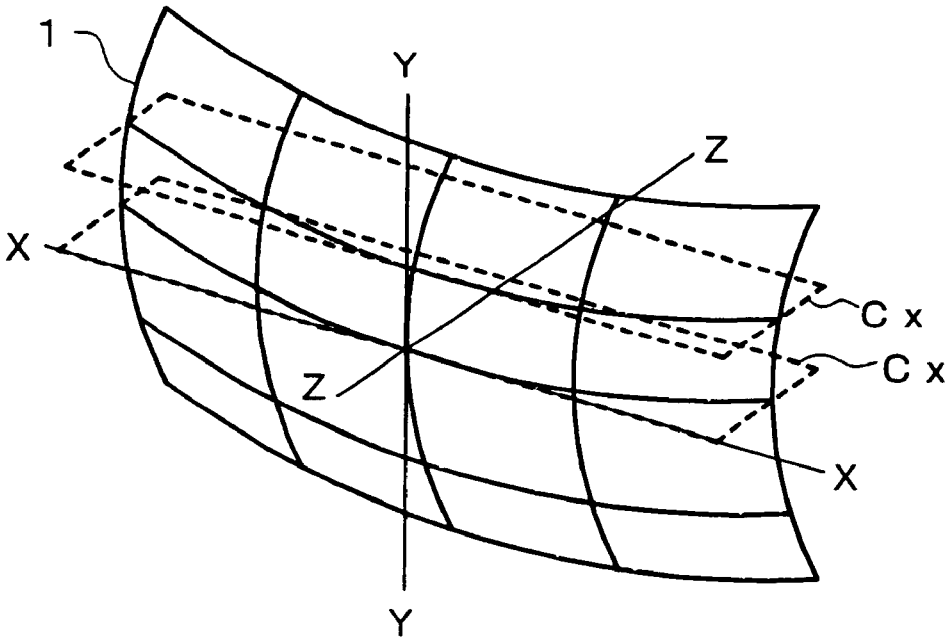
Figure 15:
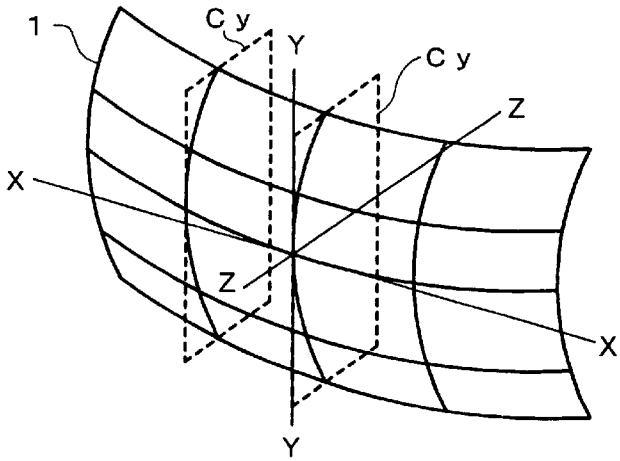

FIG. 12 is a diagram for explanation of the definition of the equivalent radius of curvature of the outer panel surface of the color cathode ray tube embodying the invention along with the definition of the equivalent radius of curvature of the inner panel surface thereof, wherein visual emphasis is made to the illustration for purposes of convenience in discussion herein. In addition, FIGS. 13 to 15 are diagrams each of which is for explanation of the equivalent radius of curvature of a 19-inch color cathode ray tube incorporating the principles of the invention. FIG. 13 shows the shape of a curved plane of either the outer panel surface or inner panel face. FIG. 14 depicts the shape of a curved plane of either the outer panel surface or inner panel face in X direction whereas FIG. 15 shows a curved plane shape of either the outer panel surface or inner panel face in Y direction. The inner/outer face shape (equivalent radius of curvature) of the panel shown in FIGS. 13–15 may be defined by Equation (4) presented later. This panel is such that the equivalent radius of curvature in the X direction stays identical in value on a cross-section or profile at any locations along the Y direction; similarly, the equivalent radius of curvature in the Y direction are kept constant in value on a profile at any locations along the X direction. Additionally it will also be permissible that the equivalent radius of curvature of either the outer panel surface or inner panel face is made substantially the same in value both in the X direction and in Y direction.

$$Z_o(x,y)=R_x-\{(R_x-R_y+(R_y^2-y^2)^{1/2})^2-x^2)\}^{1/2} \tag{4}$$

One example of the panel design scheme as defined by Equation (4) is that the outer panel surface is set in $R_x$=50,000 mm and $R_y$=80,000 mm whereas the inner panel surface is $R_x$=1,650 mm and $R_y$=1,790 mm. From the foregoing, it is to be understood that with the panel of the color cathode ray tube embodying the invention a sectional plane as cut in a tube axis direction (Z—Z) in parallel to a vertical axis (Y-direction axis) of a display screen is almost identical. Use of such curved plane shape of the panel may suppress or minimize possible distortion of display images while improving anti-implosion performance of the cathode ray tube.

Although in the description here the equivalent radius of curvature will be discussed for the X direction by way of example, the same definition is employable for others including the equivalent curvature radius in the Y direction and that in a diagonal direction. In FIG. 12, reference character "L" designates a distance from the center of panel 1 to a terminate end of its display region; $T_c$ denotes a thickness (plate thickness) at the panel center; $T_e$ indicates a thickness at the display region end; $S_{xo}$ is a drop-down amount between the center and periphery (display region end) of such outer panel surface; $S_{xi}$ is a drop-down amount between the center and periphery (display region end) of the inner panel surface, $R_{xo}$ is an outer-face equivalent radius of curvature of panel 1; and, $R_{xi}$ is an inner-face equivalent radius of curvature of panel 1. The parameters $R_{xo}$, $S_{xo}$ and L are carefully determined to satisfy:

$$R_{xo}=(S_{xo}^2+L^2)/(2S_{xo}) \tag{5}$$

The nominal 19-inch color cathode ray tube was subject to visual inspection to reveal the fact that the intended display panel surface flatness to human eyes is obtainable through setting of the outer panel surface's X-directional equivalent radius of curvature $R_{xo}$ at a specific value which is ten times greater than the reference equivalent radius of curvature $R_{vo}$ of such outer face, as given by:

$$R_{xo}=10R_{vo} \tag{6}$$

From those requirements pertaining to mass-production processes (requirements as to shadow mask press-forming), the inner panel surface's X-direction equivalent radius of curvature $R_{xi}$ at this time was determined so that its value is four times greater than the inner face's reference equivalent radius of curvature $R_{vi}$, as given by:

$$R_{xi}=4R_{vi} \tag{7}$$

Substituting a visual size value (V=18) of 19-inch color cathode ray tube to the above Equations (2)–(3) and (6)–(7), the resultant values of $R_{xo}$ and $R_{xi}$ measure $R_{xo}$=8,100 mm and $R_{xi}$=3,040 mm.

A detailed explanation will now be given of the flat panel embodying the invention. For a dot type color cathode ray tube wherein for said reference equivalent radius of curvature $R_{vo}$ of said outer panel surface and the inner panel surface's reference equivalent radius of curvature $R_{vi}$, the outer face equivalent radius of curvature $R_{xo}$ and inner face equivalent radius of curvature $R_{xi}$ in the X direction satisfy:

$$R_{xo}\geqq 10R_{vo}, \tag{8}$$

$$R_{xi}\leqq 4R_{vi}, \tag{9}$$

preferably, $$R_{xo}\geqq 30R_{vo}, \tag{10}$$

$$R_{xi}\leqq 3R_{vi}, \tag{11}$$

an inside light absorption layer and outside light absorption layer are suitable for use therein as will be set forth below.

Figure 36:
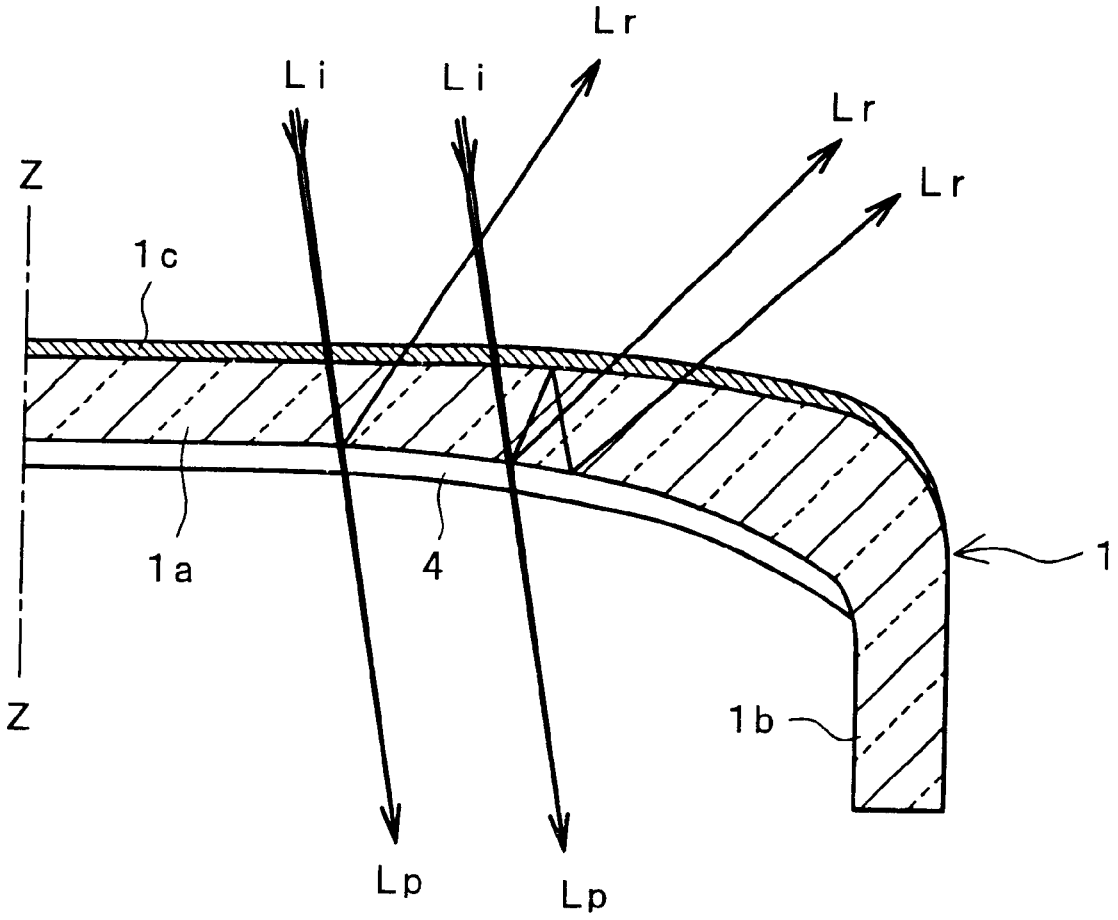
FIG. 36 is a diagram for explanation of image quality degradation due to reflection at an inner surface of external rays of light that fall onto the flat panel color cathode ray tube.

A 19-inch color cathode ray tube used for visual evaluation has its panel glass of the so called semi-clear type, which is approximately 78% in visible light transmissivity at the center part of the panel. This color cathode ray tube exhibits a ratio ($R_{xo}/R_{xi}$) of the inner face equivalent radius of curvature to the outer face equivalent radius of curvature, the ratio being set at 2.6. However, experimentation results have suggested that an increase in outer face equivalent radius of curvature does not directly lead to achievement of any expected display panel surface flatness. It may be considered that this is because of the presence of influence of reflection light rays as created at the inner face of a panel with its equivalent curvature radius less in value as shown in FIG. 36.

While a decrease in visible light transmissivity of the panel glass makes it possible to suppress such external light reflection influence, lowering the visible light transmissivity can result in an increase in brightness difference between the center portion and the periphery portion of a display screen. The display image brightness difference becomes more severe with an increase in equivalent curvature radius difference between the outer panel surface and the inner panel face and also with an increase in glass thickness at the periphery. One example is that the above-noted phenomenon was significantly observed even in the case of a color cathode ray tube of the nominal diagonal size of 19 inches with its inner face equivalent radius of curvature being set at 1,650 mm and also with an outer face equivalent radius of curvature measuring 8,100 mm (i.e. the X-direction inner-to-outer face equivalent curvature radius ratio is about 5). Another example is that the display image brightness difference was further remarkable in the case of a panel having its X-direction inner-to-outer face equivalent curvature radius ratio of 10 or more with the inner face equivalent radius of curvature measuring 1,650 mm and the outer face equivalent radius of curvature being set at 50,000 mm.

Figure 1:
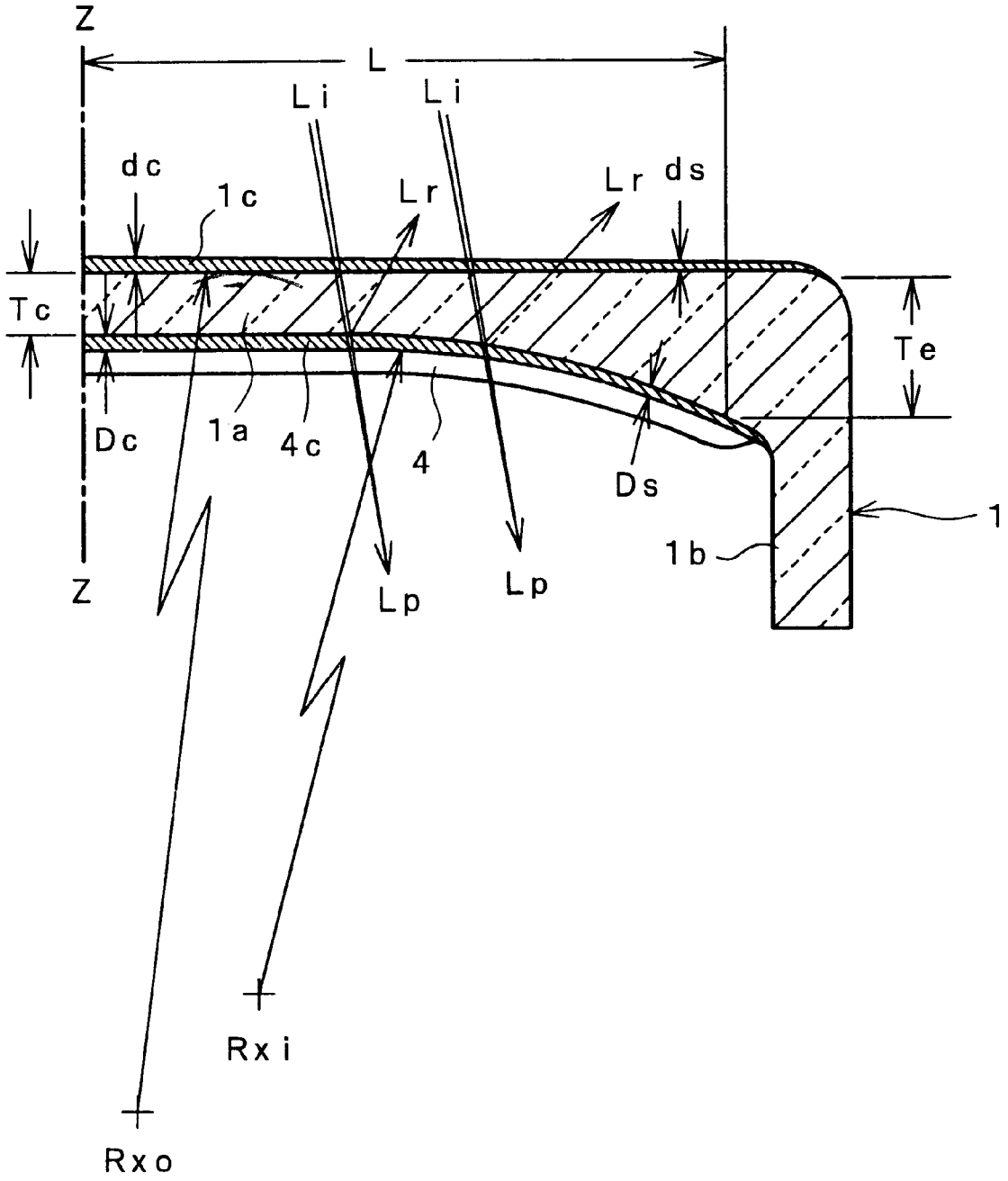
FIGS. 1–2 are diagrams each showing a cross-sectional view of main part of a panel section of a color cathode ray tube in accordance with one preferred embodiment of the present invention.

Turning now to FIG. 1, there is shown in cross-section the main part of a flat panel color cathode ray tube in accordance with one embodiment of the present invention. In FIG. 1, numeral 1 designates a panel; 1*a* denotes a display screen section of the panel; 1*b* indicates a skirt section; 1*c* is an outside light absorption layer as formed on an inner panel surface (for use as a antistatic nonglare layer); 4 indicates a phosphor screen; 4*c* is an inside light absorption layer; Z—Z shows a tube axis; $T_c$, a glass thickness at the center of the panel (central portion of the display screen section 1*a*); $T_e$, a glass thickness at the panel's peripheral part (peripheral portion of display screen section 1*a*); $L_i$, externally incoming rays of light; $L_p$, transmitted light rays after passage through the panel; $L_r$, light rays reflected off at an inner panel surface; $R_{xo}$, outer face equivalent radius of curvature of the panel 1; $R_{xi}$, inner face equivalent radius of curvature of panel 1; $d_c$, a thickness of the outside light absorption layer at the panel center; $d_s$, a thickness of the outside light absorption layer at the periphery of such panel ; $D_c$, a thickness of the inside light absorption layer at the panel center; $D_s$, a thickness of inside light absorption layer at the panel periphery.

As shown in FIG. 1, the glass thickness $T_c$ at the panel center is less in value than the glass thickness $T_e$ at the panel periphery (peripheral portion of the display screen section 1*a*). In addition the equivalent radius of curvature $R_{xo}$ of the outer panel surface is far greater than the equivalent radius of curvature $R_{xi}$ of the inner panel surface, the outer panel surface being made substantially flat (planate) in shape. The outside light absorption layer (nonglare antistatic layer) 1*c* is formed on the outer panel surface with the inside light absorption layer 4*c* being disposed between the inner panel surface and the phosphor screen 4. Although the outside light absorption layer (antistatic nonglare layer) 1*c* shown in FIG. 1 is arranged so that it is thick ($d_c$) at the center part of the panel 1 and yet thin ($d_s$) at the periphery thereof, the invention should not be limited only to such arrangement and may alternatively be modified in such a manner that in view of a relation relative to the inside light absorption layer 4*c* the outside light absorption layer (antistatic nonglare layer) 1*c* stays substantially identical ($d_c \approx d_s$) or identically the same ($d_c = d_s$) in thickness over the entire region of the outer panel surface (at least the display screen section 1*a*).

Additionally, although the illustrative inside light absorption layer 4*c* is formed so that it is thick ($D_c$) at the center part of the panel 1 and thin ($D_s$) at the periphery thereof, the invention should not be limited only to such arrangement and may alternatively be modified in a way such that in view of a relation relative to the outside light absorption layer 1*c* the inside light absorption layer is substantially identical or the same in thickness ($D_c \approx D_s$ or $D_c = D_s$) over the entire region of the inner panel surface (at least the display screen section 1*a*).

External light $L_i$ falling on the panel 1 is partly absorbed at the outside light absorption layer 1*c* upon entry to the panel 1. Part of such external light falling onto the panel 1 is then absorbed by the inside light absorption layer 4*c* while another part of it passes through the phosphor screen 4. As the external light falling on panel 1 is reflected off from the inside light absorption layer 4*c* while being partly absorbed at the inside light absorption layer 4*c*, the reflectability on the inner surface of the panel is noticeably suppressed causing outgoing reflection light $L_r$ as given off from the outer panel surface to become extremely weaker in intensity.

Figure 16:
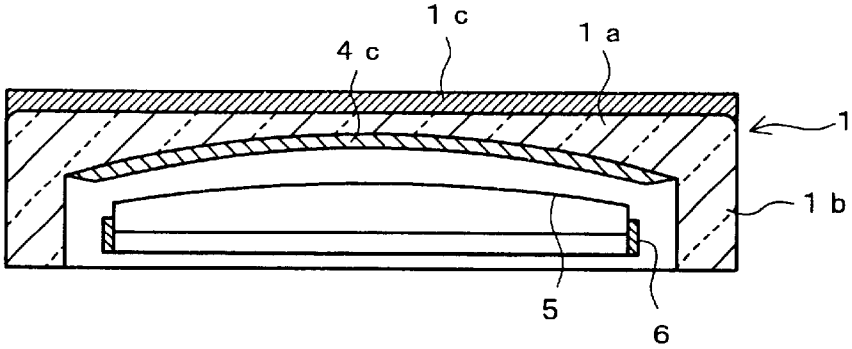
FIGS. 16 through 19 are sectional diagrams each showing panel part of the color cathode ray tube of the invention.
Figure 17:
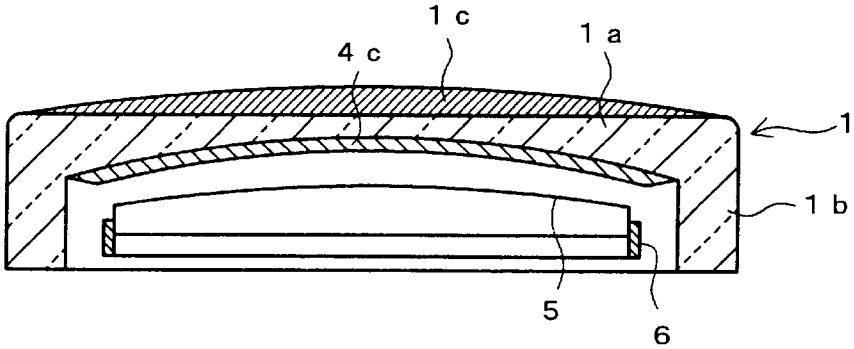
Figure 18:
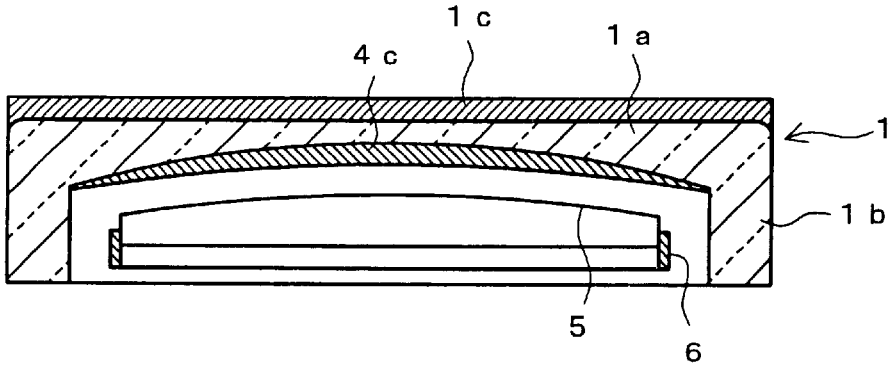
Figure 19:
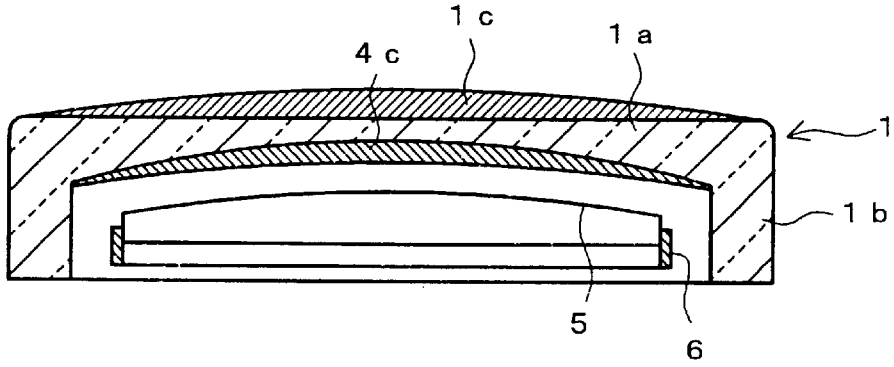

FIGS. 16 through 19 are diagrams each for use in explaining the panel section of a flat panel color cathode ray tube embodying the invention. In a respective one of FIGS. 16–19, like parts or components are designated by like reference characters as used in FIG. 35. FIG. 16 shows a structure with its inside light absorption layer 4*c* formed on the inner surface of the panel 1 to a uniform thickness and also with an outside light absorption layer 1*c* of uniform thickness being formed on the outer surface of it. FIG. 17 shows a structure with its inside light absorption layer 4*c* formed on the inner surface of panel 1 to a uniform thickness and also with an outside light absorption layer 1*c* variable in thickness being formed on the outer surface thereof, wherein the outside layer 1*c* is thick at the panel center and yet thin at the panel periphery. FIG. 18 depicts a structure with an inside light absorption layer 4*c* formed on the inner surface of panel 1 and also with an outside light absorption layer 1*c* of almost uniform thickness being formed on the outer surface thereof, wherein the inside layer 4*c* is thick at the panel center and yet thin at the panel periphery. FIG. 19 shows a structure with an inside light absorption layer 4*c* of variable thickness being formed on the inner surface of panel 1 and also with an outside light absorption layer 1*c* of variable thickness being formed on the outer surface thereof, wherein the inside layer 4*c* is thick at the panel center and yet thin at the panel periphery and wherein the outside layer 1*c* is similarly thick at the panel center and yet thin at the panel periphery.

Figure 2:
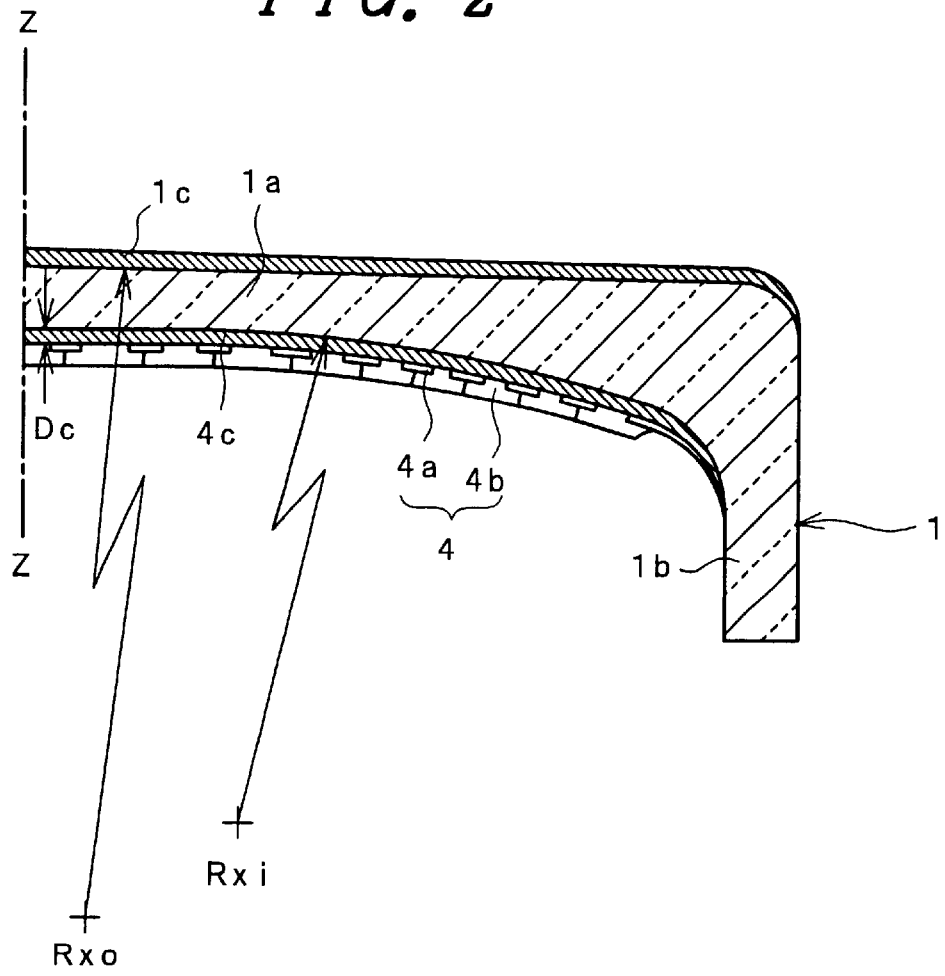
Figure 3:
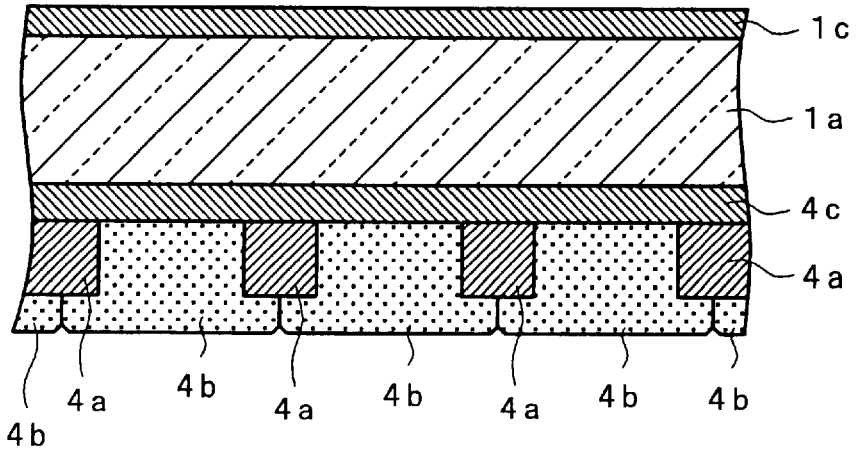
FIG. 3 is a diagram showing an enlarged sectional view of the panel shown in FIG. 2.

FIG. 2 is a diagram illustrating in cross-section main part of a flat panel color cathode ray tube also embodying the invention. FIG. 3 is an enlarged sectional view of the panel section shown in FIG. 2, wherein like parts or components are denoted by like reference characters. A phosphor screen 4 shown herein is structured from a black matrix (BM) 4*a* acting as a light absorbing matrix with phosphors 4*b* of the three primary colors—i.e. red (R), green (G) and blue (B)—being filled in openings or apertures of the matrix. This illustrative embodiment is similar in arrangement and function to that shown in FIG. 1 except that its inside light absorption layer 4*c* is directly formed inside of such phosphor screen 4, that is, directly on the panel 1's inner surface.

When viewed from outside of the color cathode ray tube of this embodiment, the lack of any intended display surface flatness will no longer take place while at the same time avoiding a decrease in contrast of display images without experiencing reduction of color purity otherwise occurring due to creation of multireflection of either external light or light emitted from phosphors at the inner and/or outer surfaces of the panel. And the color cathode ray tube of this embodiment is capable of suppressing any undesired extraneous electromagnetic radiation with the use of the outside light absorption layer having anti-reflection functionalities which may also do double-duty as an antistatic layer while simultaneously satisfying ergonomics design requirements with increased display image quality.

Figure 4:
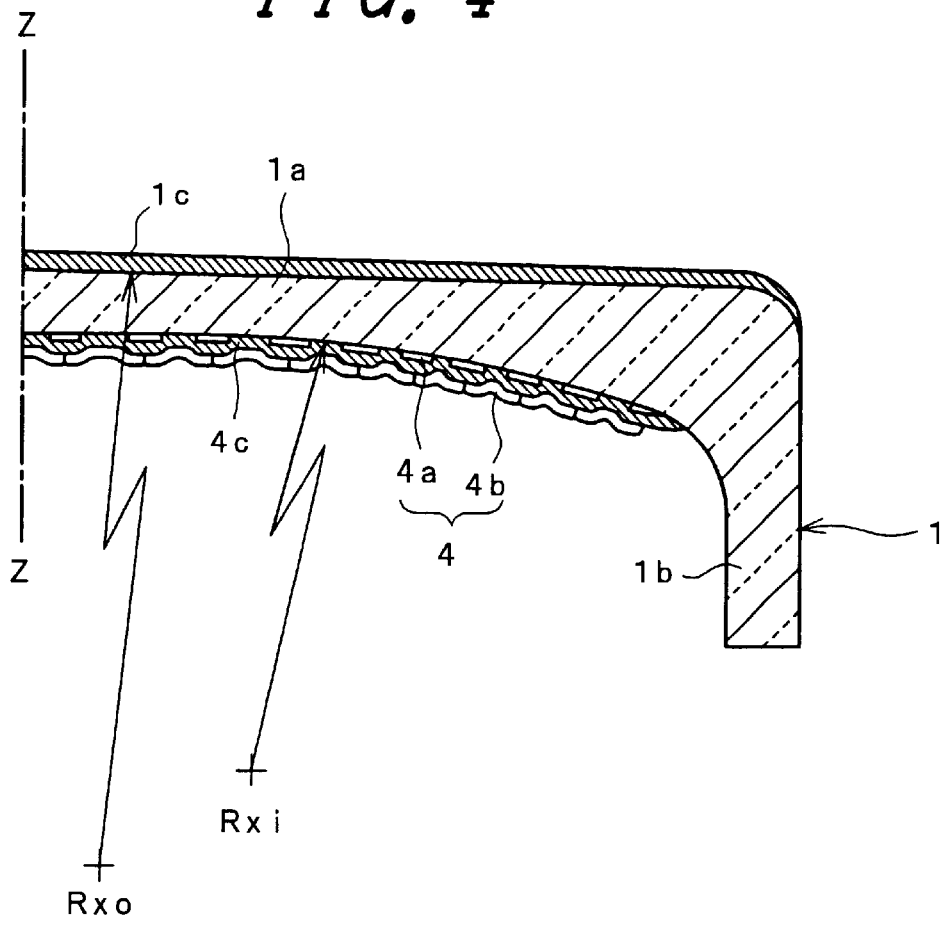
FIG. 4 shows a sectional view of main part of a panel of a color cathode ray tube in accordance with another embodiment of this invention.

FIG. 4 shows a sectional view of main part of a panel of a flat panel color cathode ray tube in accordance with another embodiment of the instant invention. See also FIG. 5, which is an enlarged sectional view of the panel section shown in FIG. 4, wherein like components are designated by like reference characters as used in FIG. 4.

Figure 5:
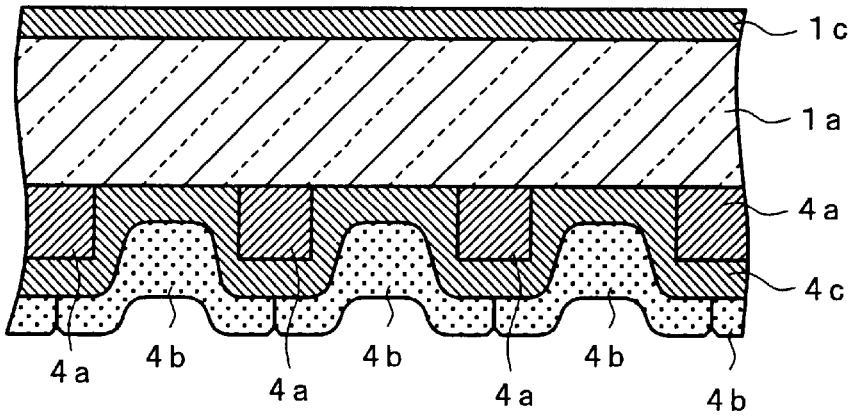
FIG. 5 depicts an enlarged sectional view of the panel of FIG. 4.

In the embodiment shown in FIGS. 4–5, a black matrix (BM) 4*a* serving as the light absorption matrix is directly formed on the panel 1's inner surface with an inside light absorption layer 4*c* being formed to overlie this black matrix (BM) 4*a*. And, phosphors 4*b* of the three primary colors are arranged to cover the inside light absorption layer 4*c* thereby forming a phosphor screen 4. The three-color phosphors 4*b* are filled into concave portions of the inside light absorption layer 4*c* which are formed at apertures of the black matrix (BM) 4*a*. Note that the remaining arrangements are the same as that of FIG. 1.

With the color cathode ray tube of this embodiment also, the lack of any intended display surface flatness will no longer take place while at the same time avoiding a decrease in contrast of display images without experiencing reduction of color purity otherwise occurring due to creation of multireflection of either external incident light or light emitted from phosphors at the inner and/or outer surfaces of the panel. And the color cathode ray tube of this embodiment is capable of suppressing any undesired extraneous electromagnetic radiation with the use of the outside light absorption layer having anti-reflection functionalities which may also do double-duty as an antistatic layer while simultaneously satisfying ergonomics design requirements with increased display image quality.

Figure 6:
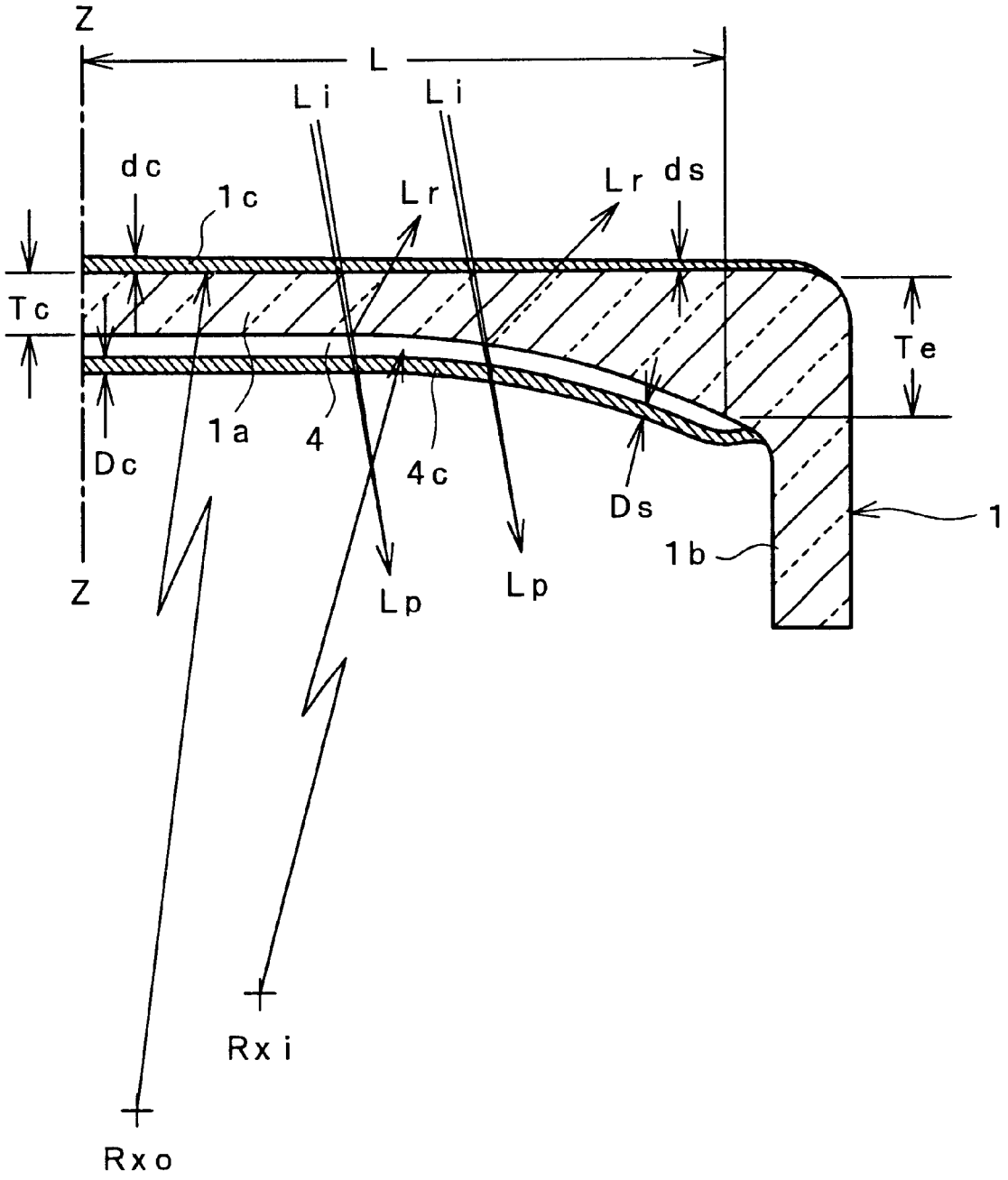
FIG. 6 is a sectional view of main part of the panel of the color cathode ray tube embodying the invention.

FIG. 6 shows a sectional view of main part of a panel of a flat panel color cathode ray tube in accordance with still another embodiment of the invention. In FIG. 6, like components are denoted by like reference characters as used in FIG. 1. With this embodiment, its inside light absorption layer 4*c* overlies the phosphor screen 4. Although in this embodiment the inside light absorption layer 4*c* has no portions in direct contact with the inner surface of the panel 1, the embodiment may advantageously reduce or suppress reflection on the inner face in case the phosphor screen 4 is thin or alternatively in case the phosphor screen 4 is large in optical transmissivity.

Figure 7:
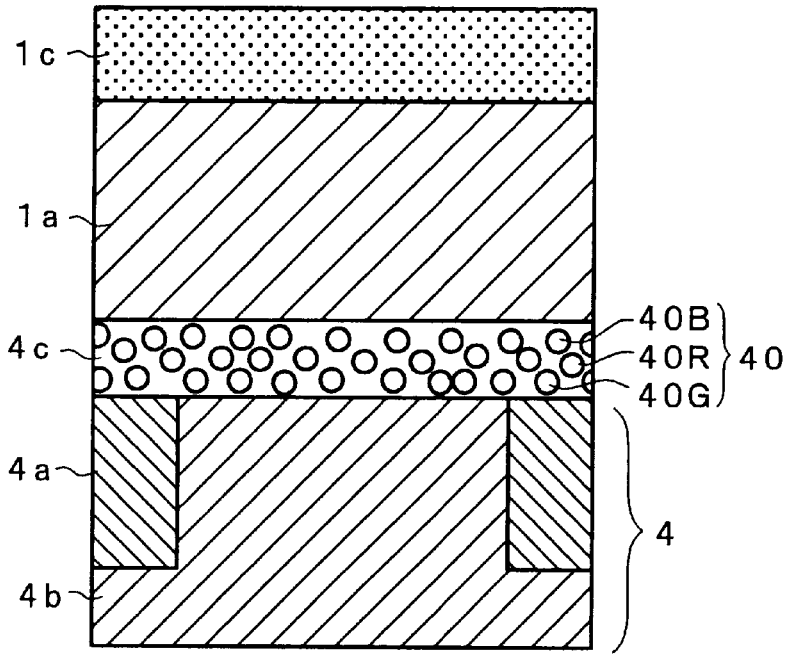
FIG. 7 is a diagrammatic representation of a panel for use in explaining the structure of an inside light absorption layer of the embodiment of the invention.

FIG. 7 is a sectional diagram presenting a pictorial representation of a panel for explanation of a structure of the inside light absorption layer of said embodiment shown in FIG. 3, wherein like parts or components are denoted by like reference characters as used in FIG. 3. The inside light absorption layer 4*c* is comprised of a mixture of inorganic pigments 40 consisting essentially of red (R) color ones 40R and green (G) 40G plus blue (B) 40B.

Figure 8:
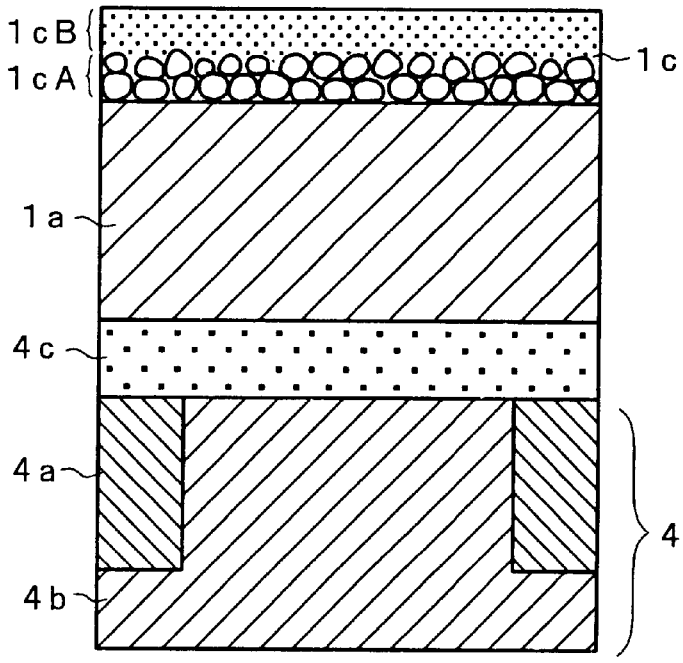
FIG. 8 is a pictorial sectional view of the panel for explanation of an outside light absorption layer of the color cathode ray tube of the invention.

FIG. 8 is a pictorial representation of a panel for explanation of the outside light absorption layer of the flat panel color cathode ray tube of the invention. The outside light absorption layer 1*c* is comprised of a multilayer structure of a layer 1*c*A and a silica layer 1*c*B, the former layer containing therein ultrafine or "micro" particles of conductive metals including but not limited to gold, silver, palladium, or a mixture of any combinations thereof.

Figure 9A:
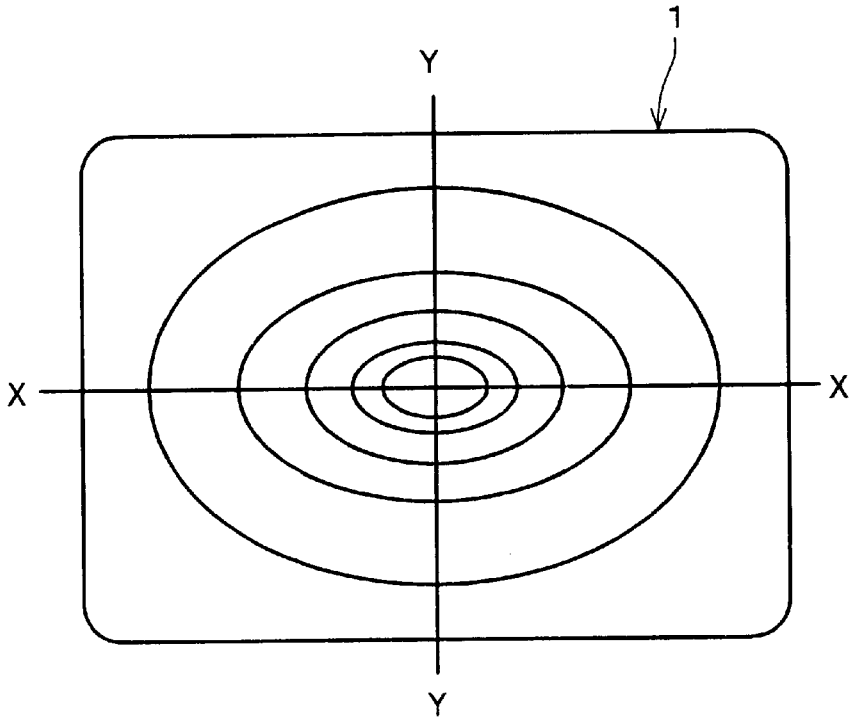
FIG. 9(*a*) is a diagram showing film thickness distribution of the outside light absorption layer.
Figure 9B:
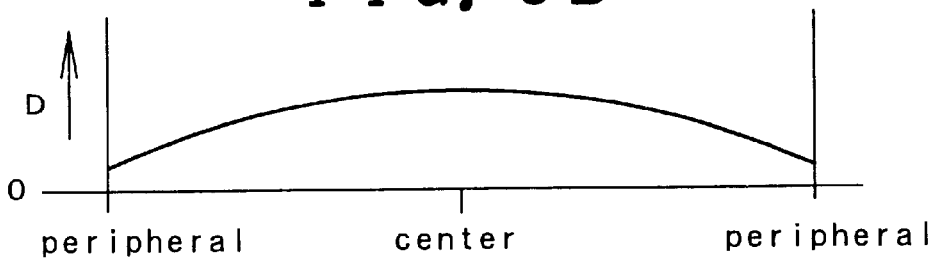
Figure 9C:
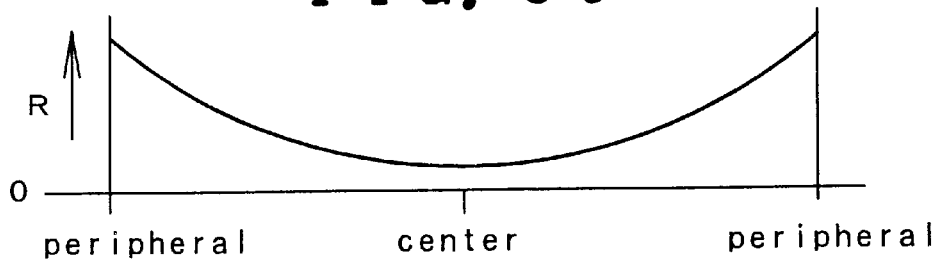

FIGS. 9(*a*) to 9(*c*) are explanation diagrams of a film thickness distribution and sheet resistance distribution of an outside light absorption layer that is formed on the outer panel surface of the flat panel color cathode ray tube embodying the invention. FIG. 9(*a*) shows a pattern of closed loops for indication of the outside light absorption layer's film thickness distribution. FIG. 9(*b*) is an explanation diagram of a distribution of film thickness (D) values of such outside light absorption layer in direction X—X of FIG. 9(*a*) whereas FIG. 9(*c*) is an explanation diagram of a distribution of sheet resistance (R) values of the outside light absorption layer.

As shown in FIGS. 9(*a*) and 9(*b*), the outside light absorption layer is specifically formed so that its film thickness is the greatest in value at the center of the panel while permitting the thickness to gradually decrease with a decrease in distance to the periphery in the X—X direction. The outside light absorption layer has its optical transmissivity which is less at the panel center and great at the panel periphery. It should be noted that although in FIG. 9(*a*) the thickness distribution is indicated in the form of laterally lengthened concentric ellipses (elliptic loops with a long axis in the X direction) with the panel center being as its center point, the distribution shape should not be limited only to this pattern and may alternatively be modified into either concentric circles or concentric elongate circles by taking account of the panel's diagonal size and aspect ratio and other parameters.

In addition, as shown in FIG. 9(*c*), the sheet resistance of the outside light absorption layer is carefully determined through control of density values of conductive particles such as said metal particles in a manner such that the resistance is low in value at the panel center and yet high at the periphery. With such an arrangement, chargeup or electrification creatable due to static electricity in a central region of the panel decreases thereby making it possible to remove away any electrification at major components in an image display region. Furthermore, what is called the extraneous electromagnetic wave (unnecessary electromagnetic emission) leakage may also be precluded with the use of the outside light absorption layer 1*c* of this embodiment because of the fact that it is stronger at the panel center and weaker at the periphery. Additionally this outside light absorption layer is potentially grounded by use of known means at a selected peripheral portion of the panel.

Figure 10:
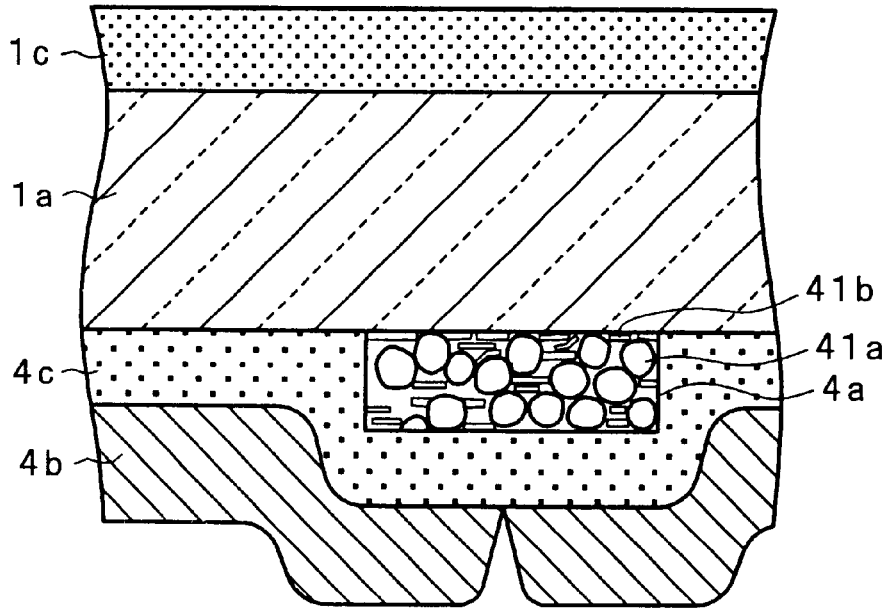
FIG. 10 is a pictorial sectional diagram for explanation of a black matrix as formed on an inner panel surface of the color cathode ray tube embodying the invention.

FIG. 10 is a pictorial sectional diagram of a black matrix (BM) as formed on the inner panel surface of the flat panel color cathode ray tube of the invention. FIG. 10 corresponds to the panel structure of the prior embodiment as has been discussed in conjunction with FIGS. 2–3. The black matrix (BM) 4*a* is the one that is comprised of a mixture of graphite microparticles 41*a* for use as optical absorptive ultrafine powdery grains and silica ($SiO_2$) microparticles 41*b* acting as optical scatterable grains. As the graphite microparticles 41*a* are generally of a flaky shape, these are excellent in close contact or adhesiveness relative to the panel 1's glass plate surface and also in optical absorptivity. On the contrary the silica microparticles 41*b* exhibit optical scatterability to permit dispersion of incident light rays and, for this reason, may suppress or minimize any unwanted reflection through dispersion of reflection light rays at a panel interface(s). Finally optical reflection at such interface may be successfully suppressed by carefully designing the silica microparticle mixture ratio to fall within a range of from 10 to 50 weight percent (wt %) of the total weight of such mixture.

Figure 11:
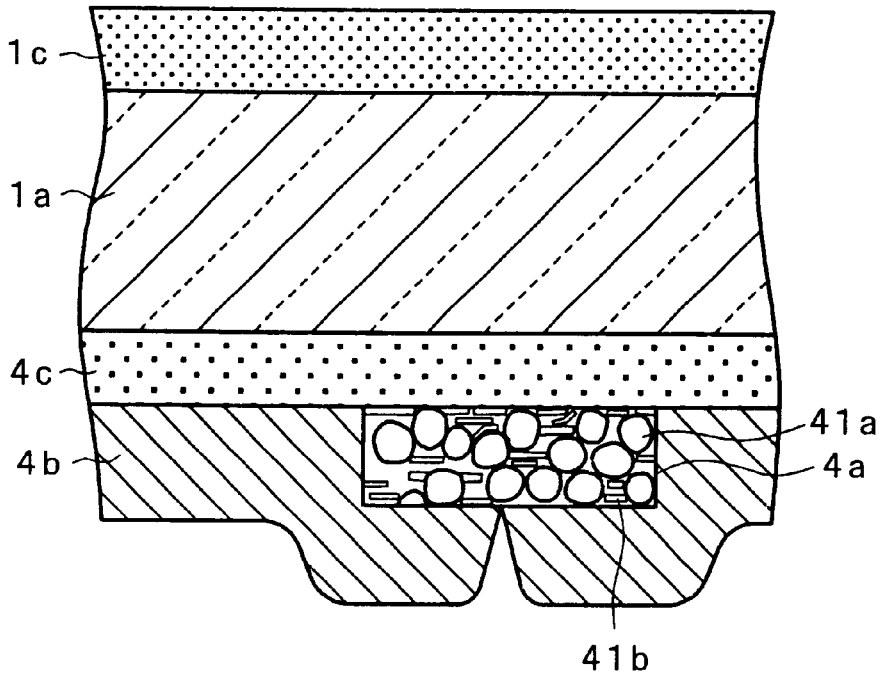
FIG. 11 is a sectional diagram for explanation of another example of the black matrix formed on the inner panel surface of the color cathode ray tube embodying the invention.

FIG. 11 is a pictorial sectional diagram of another example of the black matrix (BM) as formed on the inner panel surface of the flat panel color cathode ray tube of the invention. FIG. 11 corresponds to the panel structure of the embodiment as previously discussed in conjunction with FIGS. 4–5. As in the structure of FIG. 10 the black matrix (BM) 4*a* is the one that comprises a mixture of graphite microparticles 41*a* for use as optical absorptive ultrafine grains and silica ($SiO_2$) microparticles 41*b* acting as optical scatterable grains. As in the black matrix (BM) shown in FIG. 10, the silica microparticle mixture ratio may be designed to fall within the range of 10 to 50 weight percent (wt %) of the total weight of such mixture.

An explanation will next be given of several embodiments of the flat panel color cathode ray tube incorporating the principles of the invention as disclosed herein.

(1) Embodiment No. 1

In this embodiment a discussion was made about a flat panel color cathode ray tube with settings which follow: its effective diagonal length measures 46 centimeters (cm); a plate thickness is 11.5 millimeters (mm) at the panel center and 25.3 mm at the periphery of a display screen area; the equivalent radius of curvature on an inner panel surface is 1,650 mm in the X direction and 1,790 mm in Y direction; the equivalent radius of curvature on an outer panel face is 50,000 mm in the X direction and 80,000 mm in Y direction; the same color phosphors at central part of the panel are aligned with a horizontal dot pitch of 0.24 mm; and, the visible light transmissivity at the center of a panel glass plate is 77%. Additionally the color cathode ray tube of this embodiment is with a press-molded shadow mask which has equivalent radius of curvature of 1,329 mm in X-direction and 1,727 mm in Y-direction.

A manufacturing method of the structure is as follows. Firstly a black matrix was fabricated on the inner panel surface during standard manufacturing processes. While controlling the panel temperature to fall within a range of 42±1° C., inorganic pigment slurry of 60 $cm^3$ with Composition No. 1 below is then injected onto the inner panel face for deposition using spinner coating apparatus or equipment under the condition of spinning away at 150 rpm for thirty seconds, thereby providing a uniform coat film which is then dried by a heater resulting in fabrication of the intended inside light absorption layer with a uniform film thickness of 2 micrometers ($\mu$m). Here, the average grain diameter or size shown in Composition No.1 below is a value that has been measured using measurement apparatus of the "N type" as commercially available from Coulter Corporation whereas the film thickness of the inside light absorption layer is either a measurement value as measured using an ellipsometer or a value that has been measured through observation of a cross-section of such layer using a scanning electron microscope (SEM).

[Composition No. 1]

| Element | Content (wt %) | Average Grain Size (μm) |
|---|---|---|
| (1)Blue Pigment ($Al_2O_3$ . CoO) TMB from Dainichiseika Colour & Chemicals Mfg. Co., Ltd. | 4 | 0.05 |
| (2)Red Pigment ($Fe_2O_3$) TOR from Dainichiseika Colour & Chemicals Mfg. Co., Ltd. | 0.5 | 0.04 |
| (3)Green Pigment ($TiO_2$, ZnO, CoO, NiO) TMG from Dainichiseika Colour & Chemicals Mfg. Co., Ltd. | 0.5 | 0.06 |
| (4)Polyvinyl Alcohol P224 from. Kuraray Co., Ltd. | 0.5 | |
| (5)Surfactant Demole N from. Kao Corp. | 0.05 | |
| (6)Water | Balance | |

Thereafter, known fabrication procedures are employed to form phosphorus dots and to perform gas evacuation and aging, thus completing the cathode ray tube required. This cathode ray tube was subject to measurement of its characteristics to demonstrate the fact that it offers improved results as to both the contrast and the luminescent color reproducible range (also known as "gamut" or "color gamut" in the art to which the invention pertains) when compared to hose cathode ray tubes without use of such inside light absorption layer, as will be shown in Table 1 below.

TABLE 1

| No. | Arrangement | Contrast | Color Reproduce Range | Remarks: |
|---|---|---|---|---|
| 1 | Lack of Inside Light Absorb Layer | 100 | 100 | — |
| 2 | Use of Inside Light Absorb Layer (A) | 125 | 105 | (A):Inside light absorb layer formed after fabrication of BM |
| 3 | Use of Inside Light Absorb Layer (B) | 127 | 105 | (B):BM formed after fabrication of the inside light absorb layer |

Note here note that as shown in Table 1, in the case of the color cathode ray tube with its black matrix (BM) formed after fabrication of the inside light absorption layer also, the contrast in improved up to 127 while the color reproducible range is up to 105.

Also note that the inside light absorption layer was 80% in luminous transmissivity (LT), which is a value obtainable from Equation (12) using optical transmissivity LT(λ) within a wavelength range of 380 to 780 nanometers (nm) and also relative luminosity V(λ) of the same wavelength:

$$LT=(\int LT(\lambda)V(\lambda)d\lambda)/(\int V(\lambda)d\lambda) \quad (12)$$

Figure 20:
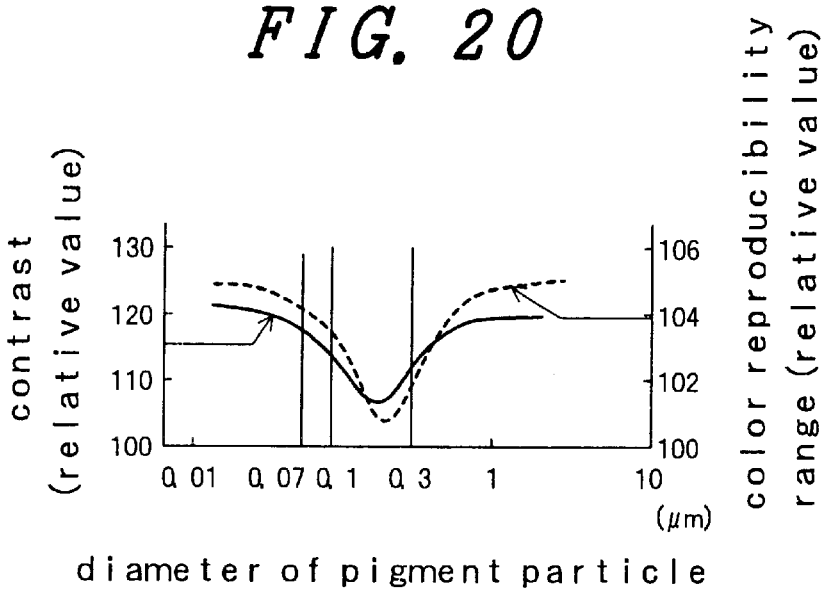
FIG. 20 is a diagram showing a relation of a pigment grain size versus contrast and color reproducibility.

FIG. 20 is a diagram showing a relation of the diameter of pigment particles for use in the inside light absorption layer versus a display image contrast and color reproducible range. The lateral axis of FIG. 20 is representative of the pigment particle diameter or grain size (μm) while the longitudinal axis is indicative of the contrast (relative value) on its left side and also of the color reproduction range (relative value) on the right side thereof. Several teachings are available from viewing FIG. 20 as will be set forth below.

① For a range in which the pigment grain size stays less in value than or equal to 0.1 μm, preferably 0.07 μm or less, resultant scattering or dispersion of visible light rays becomes smaller to allow light to reach inside of pigment particles, thereby ensuring preclusion of any possible deterioration of visible light absorption characteristics of such pigment.

② Where the pigment grain size falls within a range of from 0.1 to 0.3 μm, light is scatterable in the presence of particles, resulting in a crease in amount of light reaching inside of pigment particles, which in turn results in a likewise decrease in apparent or "virtual" optical absorbability of such pigment.

③ Within a range in which the pigment grain size is at 0.3 μm or greater, light ray dispersion due to pigment particles decreases. Additionally where the pigment grain size is 0.3 μm or above, mere use of pigment particles can result in a decrease in adhesive power relative to the panel glass face; fortunately, this may be compensated for through mixture of a binder material into the light absorption layer to thereby obtain a sufficient adhesive strength.

Consequently the optimal particle diameter range of the pigment is determined in a way which follow: (a) the average grain size is set at 0.1 μm or below in view of the adhesive strength of pigment particles with respect to the panel glass face; (b) if no consideration is taken as to such adhesive strength then the average grain size is out of the range from 0.1 to 0.3 μm—i.e. less than or equal to 0.1 μm and greater than or equal to 0.3 μm. Additionally the use of organic pigment materials will not be preferable because these can readily be degraded in quality at the stage of standard thermal processing of cathode ray tubes in the manufacture thereof.

Figure 21:
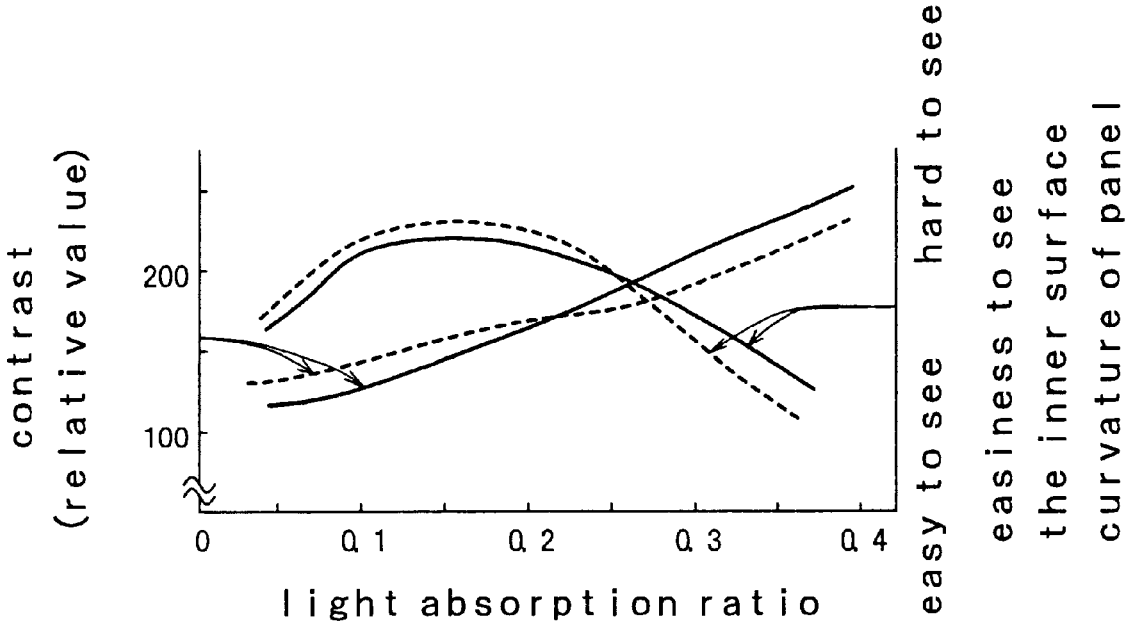
FIG. 21 is a diagram showing a relation of a pigment layer's light absorption ratio versus contrast and viewability of curvature on the inner face, wherein solid lines indicate the case of an inside light absorption layer being formed between a black matrix and its associative phosphor screen whereas broken lines indicate the case of such inside light absorption layer formed between the black matrix and panel glass.

FIG. 21 shows a relation of the inside light absorption layer's optical absorption ratio (i.e. light absorbing degree, which is a value obtained by $-\log_{10}(LT/100)$ where LT is the luminous transmissivity in unit of %) versus both the contrast and the inner panel surface's viewability of curvature. In FIG. 21, solid line indicates the case of the inside light absorption layer as formed between its associative black matrix and phosphor screen whereas broken line shows such inside light absorption layer formed between the black matrix and a panel glass plate associated therewith. As shown in FIG. 21 the contrast behaves to increase with an increase in optical absorptivity. On the other hand the curvature on the inner face is such that although it becomes harder to see while the optical absorptivity stays less than or equal to 0.2, it adversely becomes easier to see when the absorptivity goes beyond 0.2. Such change in viewability of the inner face curvature as shown in FIG. 21 is considered due to the reason which follows. As the inside light absorption layer is variable in optical density with an increase and/or decrease in optical absorptivity, a difference will obviously change accordingly, which difference is between the optical density of a glass or black matrix material (graphite) and the optical density of the inside light absorption layer per se. Where the inside light absorption layer has its optical absorption ratio which stays within a range of from 0.05 to 0.2, the resulting difference in optical density gets smaller causing reflection to likewise decrease, which results in tendency of gradual decrease in viewability of the curvature of the inner panel face. On the contrary, as said optical absorptivity increases beyond the value of 0.2, said optical density difference behaves to increase accordingly, which results in an increase in reflection thereby causing the inner face curvature to gradually becomes observable to human eyes. The optical density as used herein may be a value determinable by (n−ik')×d', where n is the refractivity, k' is the light absorb coefficient, d' is a film thickness, and i is the imaginary unit. Additionally a relation of the optical transmissivity and light absorb ratio of a panel with the inside light absorption layer formed therein is as shown in Table 2 below.

TABLE 2

| Panel Transmissivity | 40% | 60% | 80% | 90% |
|---|---|---|---|---|
| Light Absorb Ratio | 0.398 | 0.222 | 0.097 | 0.046 |

(2) Embodiment No. 2

A flat face panel with its effective diagonal length of 46 cm as in the embodiment No. 1 stated supra (horizontal dot pitch of the same color phosphors is 0.24 mm at the center of such panel) is prepared, which was cleaned and dried; then, an aqueous solution of polyvinyl alcohol (PVA) at 3 wt % with ammonium dichromate (ADC) at 8 wt % in unit of weight percent relative to the PVA is injected onto the inner panel surface of interest; after development, spin coater equipment is used to perform coating processes under the condition of spinning away at 180 rpm for twenty seconds to provide a coat film, which is then dried.

Exposure conditions are established to ensure that the dried film's ratio of an exposure amount at the central part of a panel to that at a peripheral portion of the panel is set at 5:10; for instance, exposure is done using light with its wavelength of 365 nm at an exposure intensity of 3 $W/m^2$ at the periphery for 40 seconds, which is followed by development using pure water at 40° C. for thirty seconds. Thereafter, the pigment slurry with the above-noted composition 1 is injected thereto and then dried thereby forming the inside light absorption layer in a similar way to that of the embodiment No. 1.

The inside light absorption layer thus formed has its optical transmissivity that measures 80% at or near the panel center and 85% at the panel periphery. Note that the optical transmissivity was measured using a visible light spectrometer. Here, letting the inside light absorption layer's optical transmissivity at the panel periphery be 1, the optical transmissivity at the center may be determined to range from 0.8 to 0.95.

The reason why the optical transmissivity is controllable by the above-stated methodology is as follows. Since said PVA and ADC films are expected to have a "soft" film structure with the lack of any complete hardening treatment at the panel center whereat the exposure amount is kept less, pigment materials exhibit increased permeabilities while at the same time attempting to block a flow of once-coated slurry resulting in a decrease in smoothness of flowage thereof, which in turn causes the inside light absorption layer to increase in film thickness accordingly. On the contrary, the PVA/ADC films are sufficiently hardened at the panel periphery so that the inside light absorption layer decreases in film thickness owing to the inverse action to the above case. Use of the method shown in this embodiment makes it possible to facilitate fabrication of the intended inside light absorption layer with a certain difference in optical transmissivity between the central part and the periphery of the panel while simultaneously enabling by use of the aforesaid scheme the inner panel surface to change or vary in optical transmissivity at any given locations thereon up to a range of 7 to 8%, or more or less.

(3) Embodiment No. 3

Firstly, a color cathode ray tube similar to Embodiment No. 1 was manufactured using in combination basic pigments of three primary color (red ones made of $Fe_2O_3$, green of $TiO_2$, TzO, CoO and/or NiO, and blue of $Al_2O_3$.CoO) and phosphors of the so-called "P22" type for use in standard cathode ray tubes (red ones made of $Y_2O_2S$:Eu, Sn, green of ZnS:Cu,Al and blue of ZnS:Ag), for evaluation of both white color brightness in standard chromaticity of the color white (CIE chromaticity coordinates are such that x/y is 0.283/0.298) and a current ratio (Ik ratio) required for standard white displaying, and further evaluation for pigment mixture ratios while adding thereto a specific condition that light passing through the inside light absorption layer is of almost achromatic color. In addition a design value as to drop-down of white brightness occurring due to disposal of the inside light absorption layer was set at 20%.

Results of the evaluation demonstrate that under the condition that the Ik ratio ranges from 0.7 to 1.4 whereas the white brightness drop-down is within 22%, the inside light absorption layer's pigment mixture ratio is almost determinable depending on the mixture ratio of blue and red pigments, with the mixture ratio of green ones being less in contribution. When mixing green pigments in addition to the blue and red ones to increase a rate of such green pigments, it has been observed that decrement of the white brightness increases accordingly. This suggests that a preferable mixture range is attainable when the weight ratio of blue (B) pigments to red (R) ones is between 7:1 to 17:1. The contrast in this case was from 120 to 127 whereas the color reproducible range was between 102 to 105. With regard to the curvature of the inner panel surface, this is hardly visible to human eyes as compared to those without use of any pigment layer (inside light absorption layer) on the inner panel face.

(4) Embodiment No. 4

As in Embodiment No. 1 stated supra, evaluation was done to a flat panel color cathode ray tube with its effective diagonal length of 46 cm. A black matrix was fabricated on the inner surface of a panel in a similar way to that of Embodiment 1. Then, inject onto the inner panel face a green pigment-excluded inorganic slurry of 60 $cm^3$ with composition No.2 as will be set forth later in the description; next, after having done coating by use of a spin coating machine under the condition of spinning away at 150 rpm for 30 seconds, the resultant coat film was dried by a heater to thereby fabricate an inside light absorption layer to a uniform thickness of about 1.8 $\mu$m. Here, the average grain size of the pigments used and the film thickness of the inside light absorption layer have been measured by the same method as that in Embodiment 1 discussed previously.

[Composition No. 2]

| Element | Content (wt %) | Average Grain Size ($\mu$m) |
|---|---|---|
| (1)Blue Pigment ($Al_2O_3$ . CoO) TMB from Dainichiseika Colour & Chemicals Mfg. Co., Ltd. | 5 | 0.04 |
| (2)Red Pigment ($Fe_2O_3$) TOR from Dainichiseika Colour & Chemicals Mfg. Co., Ltd. | 0.3 | 0.03 |
| (3)Polyvinyl Alcohol P224 from. Kuraray Co., Ltd. | 0.5 | |
| (4)Surfactant Demole N from. Kao Corp. | 0.05 | |
| (5)Water | Balance | |

Thereafter, known fabrication procedures are employed to form phosphorus dots and to perform gas evacuation and aging, thus completing the cathode ray tube required. This cathode ray tube was subject to measurement of its characteristics to demonstrate the fact that it offers good results as to both the contrast and the luminescent color reproducible range (called "Gamut" or "Color Gamut" in the art) when compared to those cathode ray tubes without use of such inside light absorption layer.

(5) Embodiment No. 5

As in Embodiment No. 4, a flat panel color cathode ray tube with an effective diagonal length of 46 cm was prepared, which has a panel with its inner surface cleaned and dried. Fabricated on this inner panel surface through blending was an inorganic pigment slurry which is the same in constituent elements and mixture ratio/amount as those of Composition 2 stated above, wherein the slurry contains therein several pigment microparticles consisting essentially of red and blue ultrafine particles with an average diameter of 0.07 $\mu$m, which have been separately ground by a ball milling machine from blue pigments with an average grain size of 0.1 to 0.5 $\mu$m ($Al_2O_3$.CoO, TMB as manufactured by Dainichiseika Colour & Chemicals Mfg. Co., Ltd. and red pigments with an average grain diameter of 0.1 to 0.5 $\mu$m ($Fe_2O_3$, TOR as manufactured by the above-identified Japanese company). The resultant inorganic slurry was then used to fabricate an inside light absorption layer with a film thickness of 3 $\mu$m on the inner panel surface, thus completing the color cathode ray tube in a similar way to that of Embodiment 4. This color cathode ray tube of this embodiment also offers improved contrast characteristics and enhanced luminescent color reproducible range (called "Gamut" or "Color Gamut" in the art) when compared to those cathode ray tubes without use of such inside light absorption layer.

(6) Embodiment No. 6

As in Embodiment No. 1, a flat panel color cathode ray tube with an effective diagonal length of 46 cm was prepared, which has a panel with its inner surface cleaned and dried. A chosen photo-resist material was coated on the inner panel surface to a thickness of about 0.7 $\mu$m, which material may be a polymer solution of polyacrylamide-diacetone-acrylamide (molar weight is about 700 thousands) of 1 weight percent (%) with 0.1-wt % bis-azide added thereto. After having dried this photo-resist, a shadow mask was attached to the panel to expose those locations of respective phosphors of red (R) and green (G) plus blue (B). Then, let this photo-resist undergo development using hot water to remove away specified portions residing at selected positions other than the respective phosphor locations. Next, coat the inner panel surface with a fully stirred coating liquid comprised of a graphite dispersant liquid (type No. G72B) as commercially available from Hitachi Powdered Metals Co., Ltd. and silica ($SiO_2$) microparticles (type No. SI-550P-E) with an average diameter of 0.5 $\mu$m available from Shokubai Kasei Kabushiki Kaisha, the latter being mixed into the former at a rate of 5% in weight percent (wt %) relative to graphite.

After having dried this coating liquid, let it be dipped into an aqueous solution containing 0.1-wt % hydrogen peroxide and 0.02-wt % sulfamine acid for 40 seconds. Thereafter, perform development using hot water; then, form a black matrix (BM) on the inner panel surface. Next, fabricate on this panel an inside light absorption layer made of a pigment layer in a similar way to that of Embodiment 1, thus completing the intended color cathode ray tube by standard methodology.

The resultant flat panel color cathode ray tube was then subject to visual evaluation as to the surface flatness thereof to reveal the fact that the flatness was improved when compared to those cathode ray tubes with no such inside light absorption layer. The reason of this is that unwanted reflection is reduced at the interface between a panel glass plate and graphite owing to tight adhesion of flaky graphite powders to the panel's inner glass face and also increased optical density of such graphite, in the same way as has been discussed previously in conjunction with FIG. 10. Furthermore, in addition thereto, the improvement in panel face flatness is also due to the fact that at certain contact points of $SiO_2$ microparticles as contained in the inner glass surface and the black matrix, light rays behave to directly reach inside of microparticles without reflection and then attenuate after recurrent reflection activities within the interior of such microparticles. If the average diameter of these $SiO_2$ microparticles is substantially the same as the wavelength range (380 to 780 nm) of visible light then the expected reflection suppressibility is increased or maximized.

Although in this embodiment the inside light absorption layer is made of inorganic pigments, the same effects are still obtainable with other ones such as those particles capable of withstanding application of high temperatures during manufacture of cathode ray tubes including, but not limited to, visible light absorbable ultrafine metal particles and black pigments (e.g. Mn-based ones).

(7) Embodiment No. 7

A flat panel color cathode ray tube with an effective diagonal length of 46 cm was prepared, which includes an inside light absorption layer as fabricated in a similar way to that of Embodiment 1. After having polished its outer panel surface by use of microparticle polishing materials such as cerium oxide or else, the surface is then cleaned for removal of an abradant used, followed by the process steps of washing using pure water and drying the panel face concerned.

While retaining the surface temperature of this panel at 50° C., a coating liquid with Composition No. 3 presented below was spray-coated in a spray pattern shown in FIG. 22.

[Composition No. 3]

| Element | Content(wt %) | Average Grain Size (nm) |
|---|---|---|
| (1)Au/Ag/Pd Microparticles | 0.6 | 20 |
| (2)Ethanol | 40 | |
| (3)Methanol | 50 | |
| (4)Pure Water | Balance | |

Figure 22:
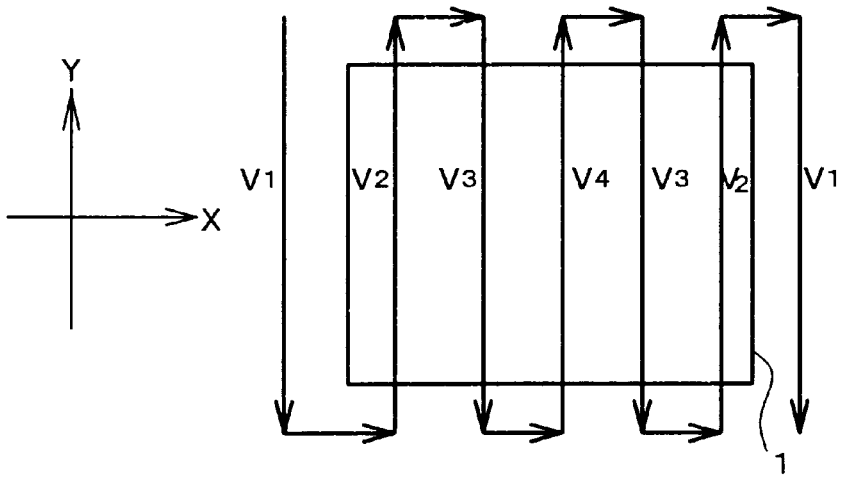
FIG. 22 is a diagram for explanation of a spray pattern for use in fabricating an outside light absorption layer (antistatic nonglare layer) overlying the outer panel face.

FIG. 22 is an explanation diagram of a spray pattern for use during fabrication of an outside light absorption layer (nonglare antistatic layer) on the outer panel surface. In FIG. 22, numeral 1 designates such outer panel surface, and each arrow indicates a traveling route of spray. Spray was done in a way such that the coating liquid was sprayed against the outer panel surface while causing Y-directional velocity to vary in a range of $V_1$ to $V_4$ in a pattern shown in FIG. 22—more specifically, letting it change so that the velocity increases at a peripheral portion of the panel and yet decreases at a central portion thereof.

The spray coating process was such that a spray gun (spray nozzle) "Model-61" manufactured by Binks to spray the solution with the above-noted Composition No. 2 for three reciprocative strokes with settings of a flow rate of the solution of 3,000 $cm^3$/h, air flow rate of 0.2 $m^3$/min, and a spacing of 200 mm between the outer panel face and the stray gun's distal end. Additionally $V_1$ was set at 600 mm/s; $V_2$ was at 400 mm/s; $V_3$, 300 mm/s; and $V_4$, 200 mm/s. After completion of such spraying, a 50-$cm^3$ coating liquid comprised of pure water containing therein 1 wt % of hydrolyzed ethylsilicate and 75 wt % of methanol plus 20 wt % of ethanol along with 0.001 wt % of nitric acid was injected to the outer panel surface while letting the panel temperature stay at 35° C.; then, spin coating was done under the condition of pinning away at a panel rotation of 150 rpm for 20 seconds, followed by the steps of drying and baking it at 160° C. for 30 minutes.

Figure 23:
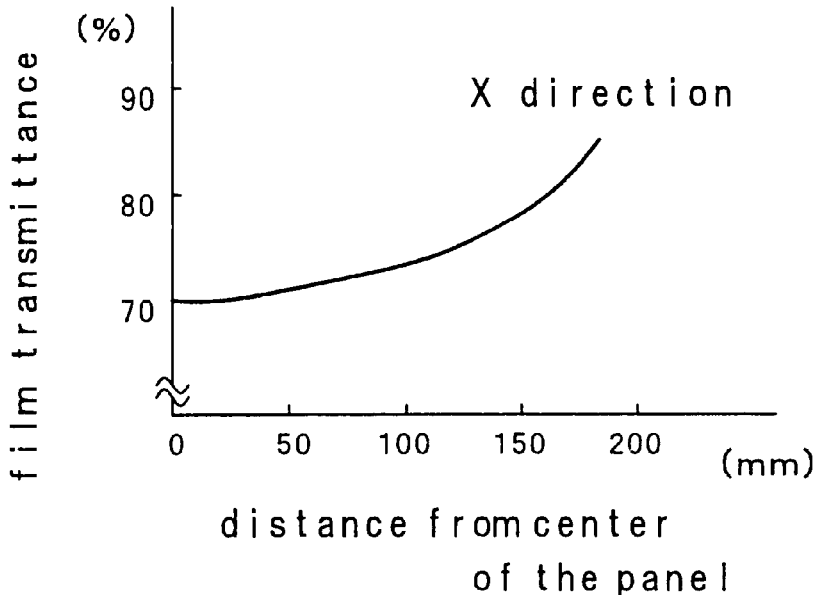
FIG. 23 is a diagram showing an optical transmissivity distribution pattern of the outside light absorption layer fabricated in FIG. 22.
Figure 24:
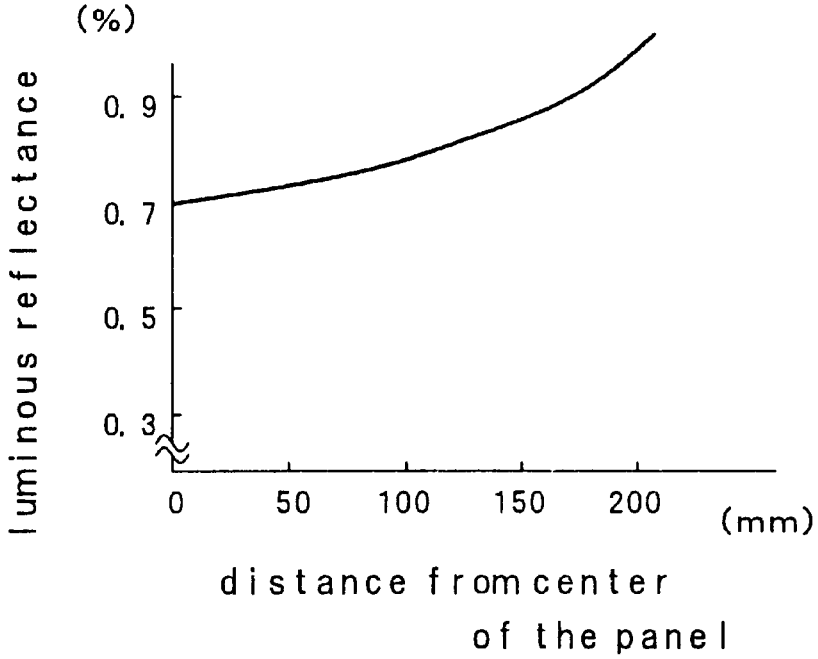
FIG. 24 is a diagram showing a relation of a distance from the panel center versus luminous reflectivity.

See FIG. 23. This diagram shows a distribution of luminous transmissivity in X direction of the outside light absorption layer thus fabricated in this embodiment. Also see FIG. 24, which is a diagram showing a relation of luminous reflectivity of the outside light absorption layer in the panel's X direction versus a distance from the center of such panel, wherein those values as measured at angle of 10 degree from a normal line segment at the panel center. Here, the luminous reflectivity (RV) was defined by Equation (13) using a reflectance R(λ) in a wavelength (λ) range of 380 to 780 nm and relative luminosity V(λ) in the wavelength (λ) range of 380 to 780 nm plus light source spectrum S(λ):

$$RV=(\int R(\lambda)S(\lambda)V(\lambda)d\lambda)/(\int S(\lambda)V(\lambda)d\lambda) \quad (13)$$

Figure 25:
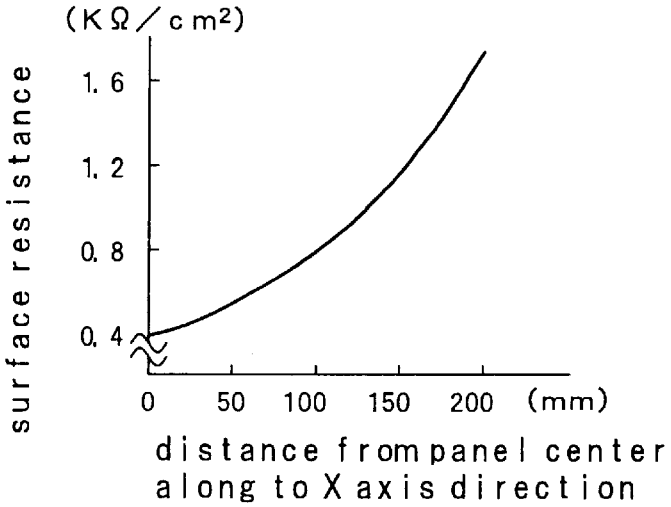
FIG. 25 is a diagram showing a relation of a distance from the panel center in an X axis direction versus surface resistivity of an outside light absorption layer.

In addition, FIG. 25 is a diagram showing a relation of a surface resistance (sheet resistivity) of the outside light absorption layer in the panel's X direction with respect to a distance from the panel center, wherein the surface resistance measures 400 Ω/$cm^2$ at the center and 1.8 kΩ/$cm^2$ at the periphery of the panel. The surface resistance values have been measured by the measurement equipment "Loresta IP" available from Dia Instrument while sticking a measurement probe into the layer so that the distal end of it penetrates an outermost dielectric layer to reach an underlying conductive layer.

(8) Embodiment No. 8

Figure 26:
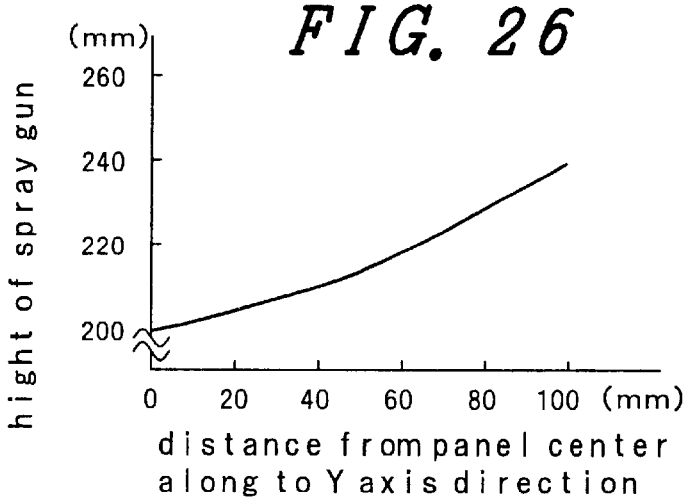
FIG. 26 is a diagram showing a relation of a distance from the panel center in Y axis direction versus height of a spray gun used.
Figure 27:
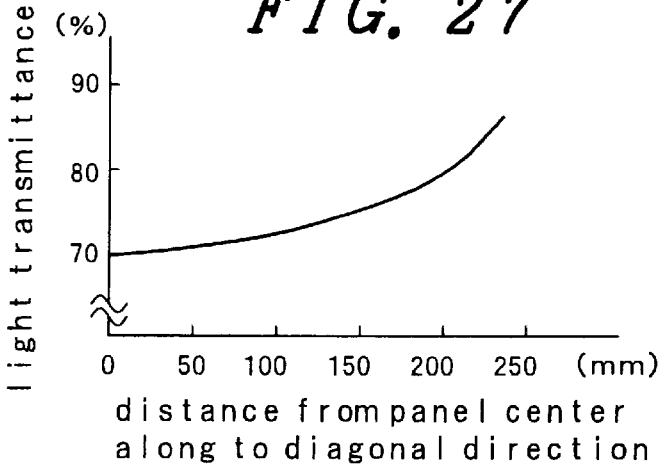
FIG. 27 is a diagram showing a relation of a distance from the panel's diagonally central part versus optical transmissivity.

The same method as in Embodiment 1 was employed to prepare a flat panel color cathode ray tube with a panel with an inside light absorption layer on its inner surface, wherein a coating liquid composition and spray nozzle (spray gun) plus spraying conditions were made identical to those of Embodiment 7 stated supra. In order to permit the outside light absorption layer (antistatic nonglare layer) to be variable in optical transmissivity in the panel's Y axis direction, the traveling velocity V ($V_1$–$V_4$) is varied as in Embodiment 7 while spraying a solution of light absorbable conductive grains or particles (gold, silver, palladium) with a height from the outer panel surface to the spray gun being changed as shown in FIG. 26 during sweeping of the spray gun in the Y axis direction of FIG. 22, followed by the steps of drying the resultant layer and then coating it with an organic solution that contains hydrolyzed ethylsilicate ($Si(OC_2H_5)_4$) in a similar way to that of Embodiment 7. Next, let the resultant solution thus coated be baked to thereby form the intended outside light absorption layer. This outside light absorption layer exhibits its optical transmissivity in a diagonal direction of the panel as shown in FIG. 27.

Experimentation results demonstrate that the color cathode ray tube of this embodiment was substantially the same as Embodiment 7 in both luminous reflectivity and surface resistivity. Although this embodiment is arranged to employ the ultrafine particles of a mixture of gold, silver and palladium, similar results are also obtainable even when these metal microparticles are changed in composition ratio or alternatively when those particles with visible light absorptivity made of silver, palladium, or other kinds of similar metals are used. Additionally the use of certain particles high in optical density makes it possible to further lower the luminous reflectivity than ever before.

(9) Embodiment No. 9

As in Embodiment 1, a flat panel color cathode ray tube was manufactured which comes with an inside light absorption layer, wherein this tube was subject to cleaning and drying processes on the outer face of its panel while appropriately adjusting layout positions of a temperature adjuster furnace and of a thermal shield plate to ensure that the center part of the panel is set at 35° C. whereas its periphery is at 45° C.

A chosen coating liquid with Composition No. 4 below was used which exhibits a well adjusted dry rate for establishment of desired viscosity effects at a coating temperature. This coating liquid with the Composition No. 4 and its volume of 60 $cm^3$ was injected to the outer panel surface and then subject to spin coating under the condition of spin away at a rotation of 150 rpm for 30 seconds. After having dried the resultant layer, a solution containing as its principal component hydrolyzed ethylsilicate ($Si(OC_2H_5)_4$) as in Embodiment 7 was coated thereon, which was next baked to thereby fabricate the outside light absorption layer required. This outside light absorption layer was such that its optical transmissivity measured in a diagonal direction spanning from the panel center up to the periphery is variable in value so that the transmissivity is less at the center and great at the center as in Embodiment 7.

[Composition No. 4]

| Element | Content (wt %) |
|---|---|
| (1)Au/Ag/Pd Microparticles | 0.6 |
| (2)Ethanol | 50 |
| (3)Ethylene Glycol | 0.2 |
| (4)Pure Water | Balance |

It should be noted that the viscosity of the ethanol/water mixed solution with the above-noted Composition No. 4 does not depend upon the density of ethanol in a specified range of ethanol content amounts of 40 to 50 wt %. On the contrary this mixture solution does exhibit appreciable temperature dependency so that the viscosity at 30° C. is about two times the viscosity at 50° C. In addition, as the coating liquid with Composition No. 4 is designed to contain ethylene glycol, the dry rate on the panel surface with a certain temperature distribution added thereto is kept constant. A greater amount of coating liquid high in viscosity resides at the center of the panel held at low temperatures whereas a less amount of low viscosity coating liquid resides at the panel periphery held at high temperatures after removal by flow out thereof. Such viscosity difference of the coating liquid due to the presence of a panel temperature difference results in creation of a difference in amount of the coating liquid, which in turn leads directly to a likewise difference in thickness of a film as fabricated through drying processes.

(10) Embodiment No. 10

A flat panel color cathode ray tube with an effective diagonal size of 46 cm was prepared, which has an inside light absorption layer as formed in a similar way to that of Embodiment 1. The outer surface of its panel was polished using microgram abradant such as cerium oxide. After removal of the abradant by use of a chosen cleaning agent, the panel face was washed with pure water and then dried. While maintaining the surface temperature of the panel of this color cathode ray tube at 50° C., spray coater equipment with a shield plate(s) was used to fabricate on the outer panel surface an outside light absorption layer (nonglare antistatic layer) with optical transmissivity varied in a pattern of concentric circular shape.

Figure 28:
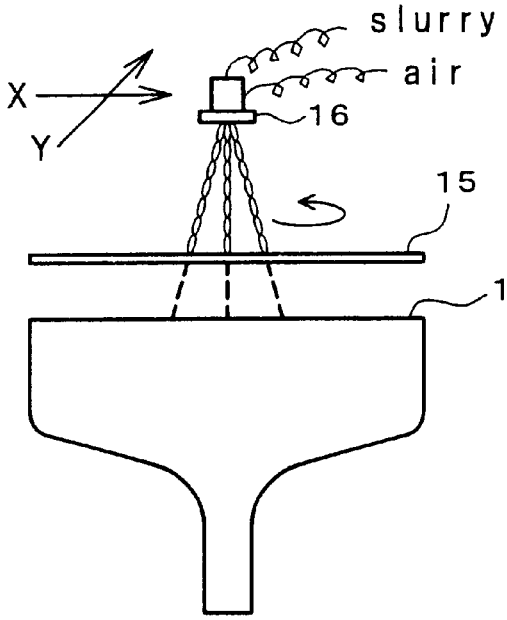
FIG. 28 is a diagram for explanation of a spraying machine of the shield plate type.
Figure 29:
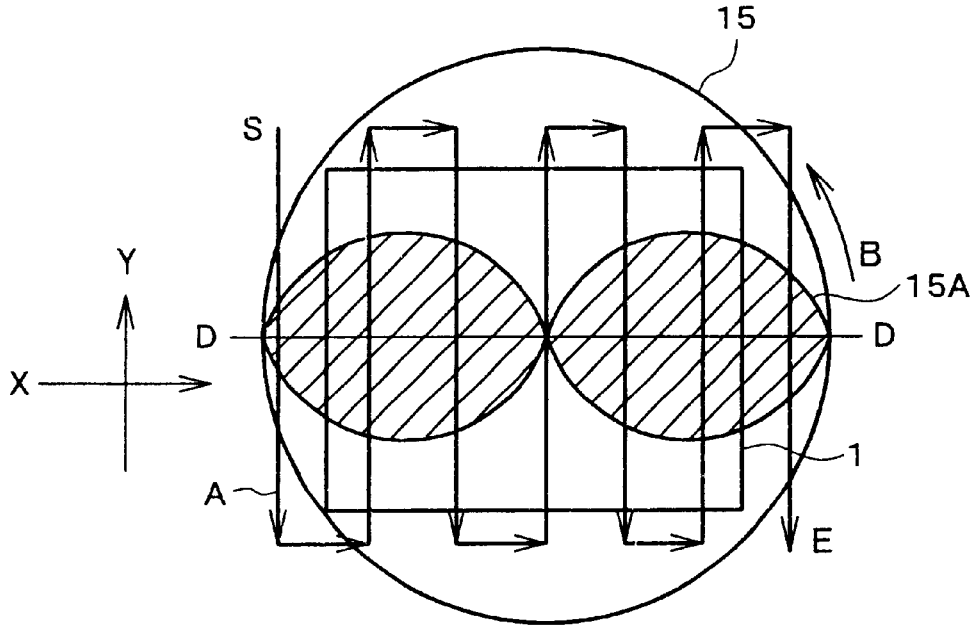
FIG. 29 is a pictorial plan view of the apparatus shown in FIG. 28 when looking at from the spray gun side.

FIG. 28 is an explanation diagram of spray coating equipment of the shield plate type. This spray coater as shown herein comes with a rotatable shield plate 15 between the panel 1 of a color cathode ray tube and a spray gun 16 overlying the panel. See also FIG. 29, which is a pictorial representation of a plan view of the FIG. 28 spray coater when looking at from the spray gun side thereof. The shield plate 15 has an opening 15A having its shape as indicated by hatching and is driven to rotate in a direction indicated by arrow B by way of example. Additionally numeral 1 denotes the surface of the panel in FIG. 28. As has been discussed previously in conjunction with FIG. 22 the spray gun 16 is driven to move both in the X direction and in Y direction to draw a spray pattern shown by arrow "A." The shield plate 15 rotates in a way synchronous with such motion or movement of the spray, thereby forming an outside light absorption layer (nonglare antistatic layer) with its optical transmissivity variable in value along a direction from a central portion of the panel 1 and a peripheral portion thereof in a pattern of concentric circular shape. Additionally the shape of the opening 15A is like a number "8" with linear symmetry relative to a line segment D—D corresponding to the shield plate's diameter.

In this embodiment the traveling speed $V_x$ in X direction of the spray gun 16 was set at 400 mm/s whereas its Y-direction travel rate $V_y$ was at 600 mm/s with a repeat number of from a start point S to end point E being set at 8 cycles. Note here that in FIG. 29, one cycle is defined as a course of reciprocal moving operations of the spray gun ginning at the point S to reach point E and then get back to point S.

Figure 30:
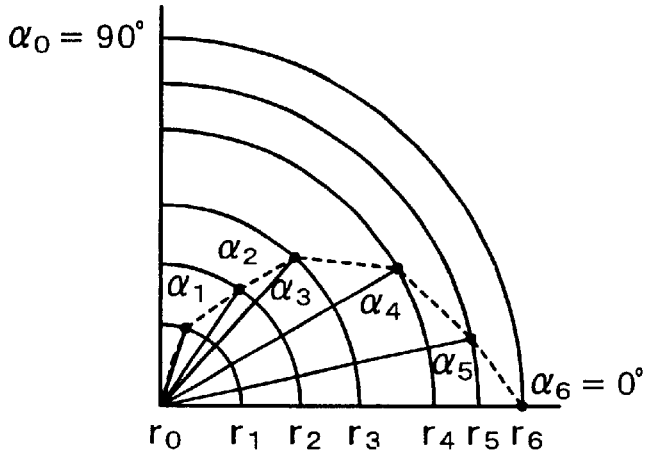
FIG. 30 is an explanation diagram of a method for determination of the aperture shape of a shield plate used.

Turning now to FIG. 30, there is shown a graph used for explanation of a method of determining the opening shape of the shield plate. In FIG. 30, "$r_0$" is used to designate the panel center (spray center). Letting an opening angle of the shield plate 15 at a distance $r_i$ from the panel 1's center (i.e. the angle that a line segment connecting between the center $r_0$ and the shield plate 15's opening end at the distance $r_i$ forms with a center line of opening 15A) be represented by $\alpha_i$, the amount of coating liquid sprayed against the panel is proportional to the opening angle $\alpha_i$. Letting a desired spray amount be $m_i$, then $m_i=k\alpha_i$. A relation of such spray amount mi versus optical transmissivity ($T_i$ may be given as $-Ln(T_i)=k'm_i$, where Ln is the natural logarithm. Hence, we obtain $-Ln(T_i)=kk'\alpha_i$, where k is a prespecified constant, and k' is the light absorb coefficient.

As apparent from the foregoing, an improved flat panel color cathode ray tube with its inner and outer panel surfaces made a substantially flat while at the same time enhancing antireflection/antistatic performance was provided by fabricating on the inner panel surface an inorganic pigment layer (inside light absorption layer) with increased light absorbability while forming on the outer panel surface a double-layered nonglare antistatic layer (outside light absorption layer) containing therein chosen microparticles having light absorbability per se (or alternatively ultrafine particles).

Additionally it has been affirmed that similar results are also obtainable even when replacing the above-stated outside light absorption layer embodying the invention with a combination of an inside light absorption layer and a direct sputter layer made of TiN—$Si_3N_4$—$SiO_2$ partly controllable in optical transmissivity such as ones available from AGC Corp. as has been applied to mass-production technologies in recent years, or alternatively a combination of a multi-layered transparent sputter film of ITO—$TiO_2$—$SiO_2$ as available from US Virate and an inside light absorption layer having a distribution of optical transmissivity added thereto, or still alternatively a combination with such inside light absorption layer having a distribution of optical transmissivity added thereto while employing transparent conductive microparticles in place of the conductive light absorbable microparticles.

An explanation will next be given of an ability to uniformly attenuate leakage electric fields on a plane extending in parallel to panel surfaces of the color cathode ray tube embodying the invention with variable on-face electrical resistivity that is lower in value at the panel center than at the panel periphery.

Figure 31A:
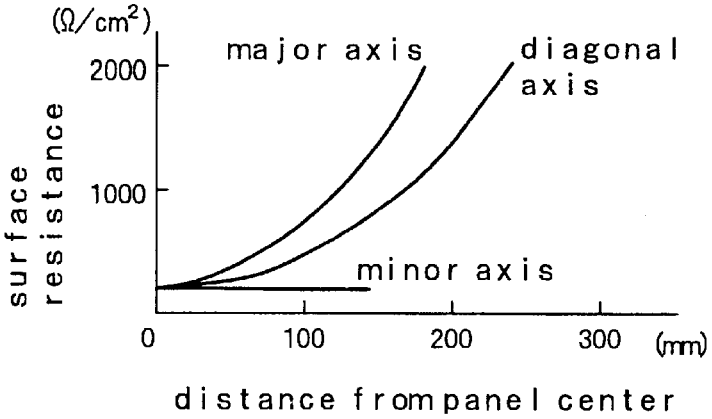
FIG. 31(*a*) is a diagram showing a relation of the outside light absorption layer's distance from the panel center versus surface resistivity thereof.
Figure 31B:
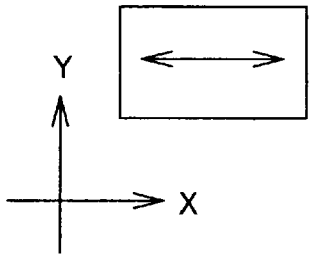

The color cathode ray tube of the invention has its outside light absorption layer whose surface resistance (sheet resistivity) is variable so that it measures $2\times10^3$ Ω/cm$^2$ or less at a central portion of the panel and is $5\times10^3$ Ω/cm$^2$ or below at a peripheral portion thereof. FIGS. 31(*a*) and 31(*b*) are diagrams for explanation of a change in significance (known as grading among those skilled in the art) of surface resistivity of an outside light absorption layer fabricated. FIG. 31(*a*) shows a grading of each of surface resistivity as measured in a short or "minor" axis (Y) and long or "major" axis (X) directions along with a diagonal axis direction; FIG. 31(*b*) shows a grading formation direction on the outer panel surface. In an embodiment shown in FIGS. 31(*a*) and 31(*b*), grading of 200 to 2,050 Ω/cm$^2$ was formed in the X direction of the panel.

Figure 32A:
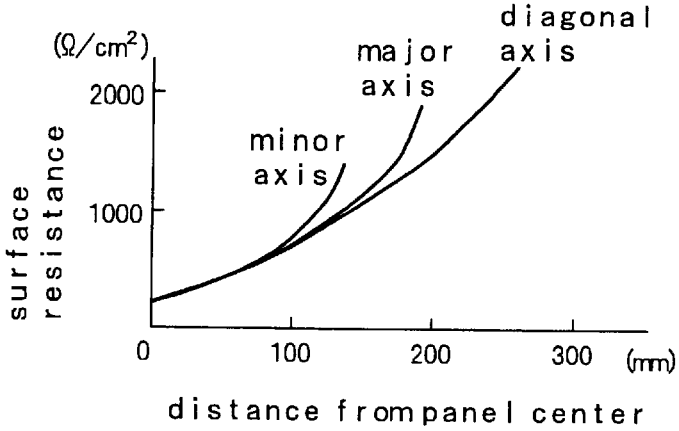
FIG. 32(*a*) is a diagram showing a relation of a distance from the panel center versus surface resistance of an outside light absorption layer of another embodiment with a surface resistance grading formed therein.
Figure 32B:
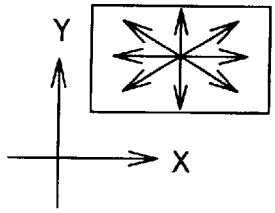

FIGS. 32(*a*) and 32(*b*) are diagrams for explanation of another embodiment of such surface resistivity grading of the outside light absorption layer of the color cathode ray tube embodying the invention. FIG. 32(*a*) shows a grading of each of surface resistivity as measured in the minor axis (Y) and major axis (X) directions along with a diagonal axis direction; FIG. 32(*b*) shows several grading formation directions of panel. In this embodiment, grading of 200 to 2,000 Ω/cm$^2$ was formed in radially from the panel center toward the periphery.

Figure 33A:
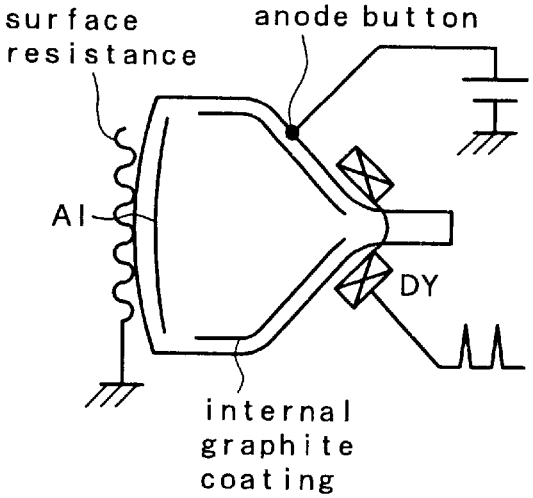
FIG. 33(*a*) is an explanation diagram of the principle of creation of a leakage electric field during operation of a color cathode ray tube.
Figure 33B:
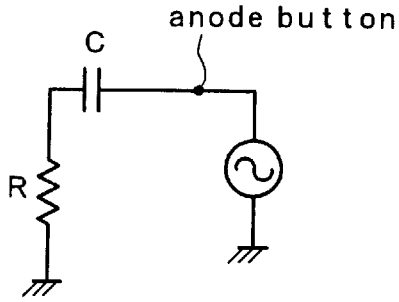

FIGS. 33(*a*) and 33(*b*) are diagrams used for explanation of the principles of creation of a leakage electric field during an operation of the color cathode ray tube. FIG. 33(*a*) is a pictorial representation, wherein a reference character "A" as used herein designates a metal back. FIG. 33(*b*) is an equivalent circuit diagram. Although in case the outside light absorption layer as formed on a glass surface is of a double-layered structure a capacitor will be formed by a low-level conductive film and its overlying dielectric film plus an electrode on this dielectric film, such capacitor is not depicted in FIG. 33(*b*). In color cathode ray tubes, electric fields as induced by possible potential variations of a high voltage being applied from a tube wall terminal (corresponding to anode button shown by numeral 10 in FIG. 35) and/or pulsate currents being supplied to a deflection yoke (DY) unit attempt to leak into outside of a color cathode ray tube through an internal conductive film (such as the one indicated by numeral 11 in FIG. 35) and inner panel surface plus outer panel surface. Fortunately such externally radiated electric field leakage may be suppressed by adjusting the panel so that its electrical resistivity on the outer surface is at an approximate value.

Prior art color cathode ray tubes are such that a difference in plate thickness between the center of a panel and the periphery thereof is about 10 to 30% of the internal thickness at the panel center resulting in a decrease in difference of electrostatic capacitance per unit area between the panel center and periphery. Letting the panel's unit area be S, panel glass's dielectric constant be $\epsilon_G$, and panel plate thickness be d, then the electrostatic capacitance C may be given as $C=(\epsilon_G \cdot S)/d$. The color cathode ray tube incorporating the principles of the invention is such that a plate thickness at the panel periphery (corner edges) is greater by 200% or above than that at the center resulting in an increase in thickness at such periphery. Thus, the resulting at-the-periphery electrostatic capacitance per unit area is half of that measured at the center, or less.

Figure 34:
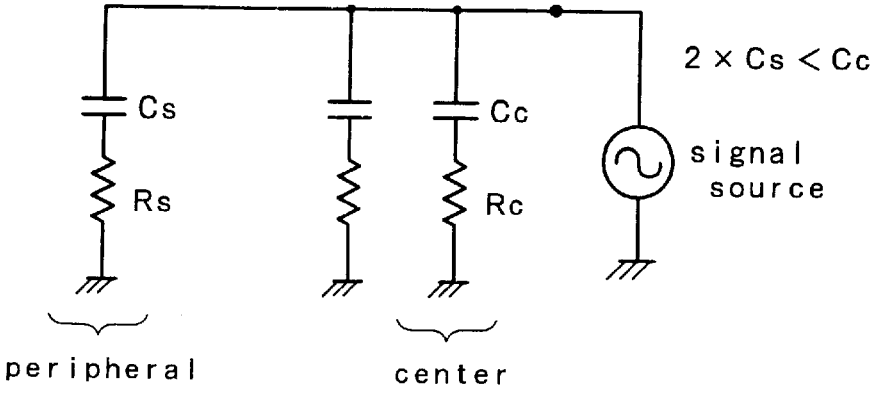
FIG. 34 is an equivalent circuit diagram of the color cathode ray tube embodying the invention.

FIG. 34 is a diagram showing equivalent circuitry of the color cathode ray tube embodying the invention. In FIG. 34, reference character $C_s$ designates an electrostatic capacitance at the panel periphery; $C_c$ denotes an electrostatic capacitance at the panel center; $R_s$ is a surface resistance at the periphery; and, $R_c$ is surface resistance at the periphery. Using $\omega=2\pi f$ (here, f is a frequency), the impedance Z of a distributed parameter circuit at the panel center and periphery is given by:

$$Z=(R^2+(1/\omega^2C^2))^{1/2} \tag{14}$$

The color cathode ray tube of this invention is increased in internal thickness d at peripheral portions of its panel whereby the resultant electrostatic capacitance $C_s$ likewise decreases resulting in an increase in surface resistance $R_s$ so that the impedance Z increases in value accordingly. On the other hand, at the panel center, its plate thickness d stays less causing electrostatic capacitance $C_c$ to increase while lowering letting surface resistance $R_c$, which results in a decrease in impedance Z. Regarding electromagnetic waves as induced from the cathode ray tube, it is stronger in intensity at the panel center and weaker at the periphery to guarantee that no electric fields behave to leak even when the impedance Z is large in value at the periphery. Optionally the sheet resistivity at the panel periphery may be five times greater than that at the center, or more or less.

An explanation will next be given of a relation of optical transmissivity of the color cathode ray tube embodiment's inside light absorption layer and panel plus outside light absorption layer with respect to several characteristics including flatness and contrast or the like. The panel with such inside light absorption layer and outside light absorption layer formed therein exhibits a total transmissivity $T_T$ (%) as represented by:

$$T_T=(T_I/100)\times(T_P/100)\times(T_O/100)\times 100 \tag{15}$$

where, $T_I$ is the optical transmissivity of inside light absorption layer, $T_P$ is the transmissivity of the panel, and $T_O$ is that of outside light absorption layer. When reduction to practice, the total optical transmissivity $T_T$ is determinable in value in a way pursuant to those values of the luminance and contrast as required for the color cathode ray tube in such a manner as to fall within a range of 35 to 55%.

Next, a relation of panel glass material versus optical transmissivity as defined by the Electronic Industries Association of Japan (EIAJ) will be set forth below.

(1) EIAJ Code No. 9001

A panel glass material with this EIAJ Code is known to exhibit its transmissivity $T_P$=90% at a glass plate thickness d=10.16 mm. In case this glass material is employed, brightness/luminance correction or compensation for on-screen display images occurring due to the presence of a plate thickness difference between the panel center and the periphery is no longer required because of the fact that the panel material per se is high in optical transmissivity. Only issue as required to be taken into consideration in this case is the influence due to optical transmissivities of the outside and inside light absorption layers.

Where the outside light absorption layer serves to absorb light rays, the lower the optical transmissivity, the greater the reflection at an interface between such outside light absorption layer and the panel glass. A general relation of the outside light absorption layer's optical transmissivity versus the reflection at the panel glass interface is as shown in Table 3 below.

TABLE 3

| | | | | |
|---|---|---|---|---|
| Transmissivity of Outside Light Absorb Layer | 60% | 70% | 80% | 90% |
| Reflection at Panel Glass Interface | 9% | 7% | 5.5% | 4.5% |

When the reflection at the interface between the outside light absorption layer and panel glass goes beyond 7%, influence of multi-reflection occurring between the inner panel glass surface and outer panel glass surface increases badly affecting display images' flatness and contrast and the like.

(2) EIAJ Code Nos. H8602 & H8603

Panel glass materials with EIAJ Code Nos. H8602 and H8603 are known to have transmissivities $T_P$=85.5 and 86% respectively at a glass plate thickness d=10.16 mm. In case these glass materials are used, a difference in optical transmissivity between the glass panel center and its periphery is about 6.5%.

(3) EIAJ Code No. H8001

A panel glass material with EIAJ Code #H8001 is known to have transmissivity $T_P$=80% at a glass plate thickness d=10.16 mm. In case this panel material is employed, a difference in optical transmissivity between the glass panel center and its periphery becomes about 8%.

(4) EIAJ Code No. H7302

A panel glass material with EIAJ Code #H7302 is known to have transmissivity $T_P$=73% at a glass plate thickness d=10.16 mm. In case this panel material is used, a difference in optical transmissivity between the glass panel center and its periphery becomes about 18%.

(5) EIAJ Code No. H5702

A panel glass material with EIAJ Code #H5702 is known to have transmissivity $T_P$=56.8% at glass plate thickness d=10.16 mm. When this panel material is used, the resultant optical transmissivity is variable in value so that it measures 53.6% at the panel center and 28.3% at periphery, which suggests that the optical transmissivity at panel periphery is less than an ideal value level, i.e. 35%.

Defining the total optical transmissivity by use of a flatness attainable range and a level with the other characteristics being kept preferable while also taking account of the results indicated at the above paragraphs (1) to (5) in combination with the fact that the above-noted inside light absorption layer's appropriate optical transmissivity values of 55 to 85% and the outside light absorption layer's adequate optical transmissivity values of 70 to 90%, the resultant optical transmissivities of the inside and outside light absorption layers as measured at the panel center is as shown in Table 4 below.

TABLE 4

| EIAJ Code # | Optical Transmissivity (%) | | | |
|---|---|---|---|---|
| | Panel $T_P$ | $T_T$ | $T_I$ | $T_O$ |
| H9001 | 90 | 35–55 | 43–68 | 90 |
| H8602/H8603 | 85 | 35–55 | 55–72 | 70–90 |
| H8001 | 77 | 35–55 | 61–80 | 70–90 |
| H7302 | 71 | 35–55 | 66–86 | 70–90 |

It will be preferable to lower the optical transmissivity $T_I$ of an inside light absorption layer while increasing the optical transmissivity $T_O$ of an outside light absorption layer, thereby attaining a desired total optical transmissivity $T_T$. Providing value setup falling within the above-defined panel center's optical transmissivity range to permit the panel periphery and panel center to be equal in total optical transmissivity to each other or alternatively let the panel periphery offer an about 10% increased optical transmissivity makes it possible to accomplish the intended flat panel color cathode ray tube that is excellent in surface flatness while offering enhanced contrast characteristics and extended color reproduction ranges.

What is claimed is:

1. A color cathode ray tube comprising an evacuated envelop including a panel portion, a neck portion and a funnel portion for connecting said panel portion and said neck portion, a phosphor screen formed on an inner surface of said panel portion, and an electron gun housed in said neck portion, characterized in that while letting a main scanning direction of a display screen formed of said panel be given as an X direction and a direction at right angles to the main scan direction be given by a Y direction, an equivalent radius of curvature of an outer surface of said panel at least in the X direction is greater by 2.6 times or above than an equivalent radius of curvature of the inner panel surface, that said panel has on its inner surface an inside light absorption layer and also has on the outer surface of said panel an outside light absorption layer including a reflection prevention film and an antistatic film, and that light absorption of said outside light absorption layer is greater at central part of said panel while being less at a peripheral portion.

2. The color cathode ray tube as recited in claim 1, characterized in that said outside light absorption layer is formed of a plurality of layers including an electrical insulative layer and more than one electrical conductive layer, and that sheet resistivity at the central part of said electrical conductive layer is less than sheet resistivity at the peripheral portion.

3. The color cathode ray tube as recited in claim 2, characterized in that said electrical conductive layer contains therein conductive particles.

4. The color cathode ray tube as recited in claim 3, characterized in that density of said conductive particles is such that density at the central part of said panel is greater than density at the peripheral portion thereof.

5. The color cathode ray tube as recited in claim 4, characterized in that said conductive particles are metal particles.

6. The color cathode ray tube as recited in claim 4, characterized in that said conductive particles are metal particles with optical absorptivity.

7. The color cathode ray tube as recited in claim 1, characterized in that said outside light absorption layer comprises a plurality of laminated layers including a spray formation layer as fabricated through spraying of a light absorptive liquid while causing a spray nozzle to move two dimensionally in said X direction and Y direction of said panel and a spinner formation layer formed through drop-down of light absorptive liquid using a dispenser while rotating said panel.

8. The color cathode ray tube as recited in claim 7, characterized in that when letting said spray formation layer and said spinner formation layer be combined into a pair, said spray formation layer is closer in position to the outer panel surface than said spinner formation layer.

9. The color cathode ray tube as recited in claim 7, characterized in that optical absorptivity of said spray formation layer is great at the central part of said panel and less at a peripheral portion thereof.

10. The color cathode ray tube as recited in claim 7, characterized in that said spray formation layer has electrical conductivity.

11. The color cathode ray tube as recited in claim 10, characterized in that sheet resistivity of said spray formation layer at the central part of said panel is less than sheet resistivity at the peripheral portion thereof.

12. The color cathode ray tube as recited in claim 1, characterized in that the antistatic film making up the outside light absorption layer as formed on said outer panel surface has its sheet resistivity of less than or equal to 2 $k\Omega/cm^2$ at the central part of said panel.

13. The color cathode ray tube as recited claim 7, characterized in that said spray formation layer is with a rotation shield plate lying between the outer surface of said panel and said nozzle and partly having more than one opening to thereby permit said optical absorptivity to be great at the central part of said panel.

14. That color cathode ray tube as recited in claim 1, characterized in that said outside light absorption layer is a shadow wing spray formation layer as fabricated through spraying of a light absorptive liquid while causing a spray nozzle to move two dimensionally at a constant speed in both the X direction and the Y direction of said panel and also causing a rotation shield plate partly having one or more openings to be placed between the outer surface of said panel and said nozzle.

* * * * *